US006015208A

United States Patent [19]

Wakahara et al.

[11] Patent Number: 6,015,208

[45] Date of Patent: Jan. 18, 2000

[54] DRIVING CIRCUIT FOR A CONTROL ELECTRODE PROVIDED IN AN IMAGE FORMING APPARATUS

[75] Inventors: Shirou Wakahara, Osaka; Kazuya Masuda, Nara, both of Japan

[73] Assignee: Sharp Kabushiki Kaisha, Osaka, Japan

[21] Appl. No.: 09/007,157

[22] Filed: Jan. 14, 1998

[30] Foreign Application Priority Data

Jan. 23, 1997 [JP] Japan ..... 9-010593
Aug. 14, 1997 [JP] Japan ..... 9-219646

[51] Int. Cl.[7] ..... B41J 2/06

[52] U.S. Cl. ..... 347/55

[58] Field of Search ..... 347/59, 55, 154, 347/103, 113, 111, 159, 127, 128, 17, 141, 120, 151; 326/109; 346/74.2, 74.3, 74.5; 399/229, 282, 272, 267

[56] References Cited

U.S. PATENT DOCUMENTS 4,701,635 10/1987 Kawazoe et al. ..... 326/109
5,239,318 8/1993 Vannerson .
5,517,224 5/1996 Kaizu et al. ..... 347/59

FOREIGN PATENT DOCUMENTS 0 720 072 7/1996 European Pat. Off. .
0 788 887 8/1997 European Pat. Off. .
57-062070 4/1982 Japan .
5-50647 3/1993 Japan .
9-240038 9/1997 Japan .

*Primary Examiner*—John Barlow
*Assistant Examiner*—Raquel Yvette Gordon
*Attorney, Agent, or Firm*—David G. Conlin; David A. Tucker

[57] ABSTRACT

A driving circuit includes: a first semiconductor switch with its source connected to a high-voltage power source; amultiple number of diodes with their anodes commonly connected to the drain of the first semiconductor switch; a multiple number of second semiconductor switches, each being connected at the drain to the cathode of the corresponding diode and the sources being commonly connected to a low-voltage power source. In this configuration, the first semiconductor switch is turned on so that all the outputs once have the high voltage supplied and then the plural second semiconductor switches are selectively turned on so as to output the low voltage from their output terminals.

14 Claims, 25 Drawing Sheets

DRIVING CIRCUIT FOR A CONTROL ELECTRODE PROVIDED IN AN IMAGE FORMING APPARATUS

BACKGROUND OF THE INVENTION (1) Field of the Invention

The present invention relates to a driving circuit for a control electrode provided in an image forming apparatus such as a copier which forms visual image by making the developer jump by electrical force.

(2) Description of the Prior Art

Recently, as an image forming apparatus which reproduces an image signal into a visual image output on a recording medium such as paper etc., an image forming apparatus has been disclosed in Japanese Patent Application Laid-Open Hei 5 No. 50,647. The image forming apparatus in this disclosure forms visual images on the recording medium by making statically charged toner jump by electric force (electric field) whilst the toner's direction of jumping is controlled by a control electrode arranged in the toner transfer path.

The control electrode provided in this image forming apparatus is in a flat-plate form with a plurality of holes formed therein. Each of these holes is provided with an annular electrode therearound forming a gate for controlling the passage of toner flow. Voltages are selectively applied to each annular electrode, i.e., each gate in accordance with the image signal so as to control the distribution of the electric field. Resultantly, the toner's direction of jumping is determined and hence an image in accordance with the image signal is formed on the recording medium.

Referring now to FIGS. 1 to 6, the configuration and the operation of this image forming apparatus will be shown by exemplifying a digital copier.

The present image forming apparatus can be applied to a printing section of a printer for example, other than digital copiers and has a sectional configuration schematically shown in FIG. 1. That is, the image forming apparatus has in its center an image forming unit 1 for forming an image by making toner as the developer adhere to the recording medium. Provided on the paper input and output sides of image forming unit 1 are a paper feeder 10 for supplying paper to image forming unit 1 and a fixing unit 11 for fixing the toner image formed on the paper by image forming unit 1, with heat and pressing.

Image forming unit 1 is composed of, as detailedly shown in FIG. 2, a toner supplying section 2 and a printing section 3. Toner supplying section 2 is composed of a toner storage tank 20 for storing toner 21 as the developer, a drum-shaped toner support 22, a doctor blade 23 which regulates the thickness of the toner layer carried on the peripheral surface of toner support 22 and negatively charges the toner.

Toner 21 is of a magnetic type having a mean particle diameter of, for example, 6 $\mu$m, and is electrified with static charge of e.g., −4 $\mu$C to −5 $\mu$C per gram by doctor blade 23. Here, the thickness of the toner layer carried on the peripheral surface of toner support 22 is regulated at 60 $\mu$m. In the description of this embodiment, a configuration for negatively charged toner will be detailed, but it is also possible to configure a system which uses positively charged toner.

Here, toner support 22 is rotationally driven by an unillustrated driving means in the direction indicated by arrow A in the figure, with its surface speed set at about 80 mm/sec, for example. Toner support 22 is grounded and has unillustrated fixed magnets therein, at the position opposite doctor blade 23 and at the position opposite a control electrode 26 (which will be described later). Magnetic force from these magnets enables toner 21 to stand up in 'spikes' at the areas on the peripheral surface corresponding to the positions thereof. Here, instead of magnetic force, it is also possible to configure a system which supports the toner by electric force or combination of electric and magnetic forces.

Printing section 3 includes: an opposing electrode 25 arranged facing the peripheral surface of toner support 22; a high-voltage power source 30 for supplying a high voltage to the opposing electrode; a control electrode 26 provided between toner support 22 and opposing electrode 25; a dielectric belt 24 for conveying a sheet of paper 5 toward the upper portion of opposing electrode 25; a pair of rollers 16*a* and 16*b* for driving dielectric belt 24; a charging brush 8 for charging paper 5; a charger-power source 18 for supplying a charger voltage to charging brush 8; a charge erasing brush 28 for erasing charge on paper 5; a charge erasing power source 17 for applying a charge erasing voltage to charge erasing brush 28; and a cleaner blade 19 for cleaning the surface of dielectric belt 24.

Control electrode 26 as a part of printing section 3 has a configuration with its top surface schematically shown in FIG. 3. That is, the electrode has annular electrodes 27 each encircling a hole H; this hole H and annular electrode 27 form a gate 29 as the passage for jumping toner flow. A driving signal is given from a driving circuit 31 shown in FIG. 2 to each annular electrode 27 via a feed line 28, so as to control the direction of jumping flow of the toner transferring from toner support 22 to opposing electrode 25, as will be described hereinbelow.

Control electrode 26 shown in FIG. 2 has only one gate 29 shown for convenience, but a plurality of gates 29 are arranged regularly as briefly shown in FIG. 3. In practice, gates 29 are arranged at about 2,560 sites, for example, but the number and shape are not particularly limited.

Toner support 22 is composed of a substrate of a non-magnetic material such as aluminum. Dielectric belt 24 is formed of a substrate made up of PVDF of about 75 $\mu$m thick with a volume resistivity of about $10^{10}$ □·cm. Opposing electrode 25 is arranged, for example, about 1.1 mm apart from the peripheral surface of toner support 22 and has a high voltage application of e.g., about 2.3 kV from high voltage source 30 so as to form an electric field between itself and toner support 22. Rollers 16*a* and 16*b* are rotated by an unillustrated driving means so that dielectric belt 24 will run at a velocity of about 30 mm/sec. in the direction of the arrow in the figure.

Although unillustrated, the image forming apparatus shown in FIG. 2 also includes: a main controller for controlling the whole apparatus; an image processor for image processing the image data; an image memory for storage of the processed image data; and an image forming control unit for converting the image data obtained after image processing into an image signal to be given to control electrode 26.

In accordance with the image forming apparatus thus configured, in FIG. 2, whilst paper 5 is being conveyed over opposing electrode 25 at a uniform speed by dielectric belt 24, the toner (negatively charged) carried on toner support 22 jumps and statically adheres to the upper surface of the conveyed paper 5 by the action of the electric field formed between toner support 22 and opposing electrode 25.

The toner's direction of jumping is determined by the potential of each gate 29 (annular electrode 27) of control electrode 26. That is, the potential of each annular electrode 27 is controlled by driving circuit 31 based on the image signal obtained from the conversion of the aforementioned unillustrated image forming control unit. The distribution of the electric field near control electrode 26 is controlled in accordance with the driving signal given from driving circuit 31, so that the toner's direction of jumping is controlled.

When, for example, a voltage of 150 V is applied to a gate 29, this gate promotes the passage of the toner (negatively charged) therethrough. When a voltage of −200 V is applied, the gate stops the passage of toner. Each gate has a selectively pulsed driving signal given from driving circuit 31 in accordance with the image signal, whereby the passage (and the direction of jumping) of the toner flow will be controlled in accordance with the image.

The control electrode 26 exemplified in FIG. 3 has one annular electrode 27 for each gate 29 and each gate is individually supplied with a driving signal via its feed line 28. In contrast, as shown in FIG. 4, there is another type of control electrode (to be referred to as 'matrix type control electrode') which has gates 29 at crossover points between two layered strip-like electrodes 27*a*, rows and 27*b*, columns and controls the potential state of each gate 29 by the relationship between electrodes 27*a* and 27*b*. In this type, the number of signal lines (feed lines) can be reduced and the scale of its driving circuit can be downsized.

Next, the copying operation in the digital copier as the image forming apparatus thus configured will be described following a flowchart shown in FIG. 5. In the description, reference to FIGS. 1 to 4 should be made as required.

First, when with an original to be copied placed on the image pickup section (without numeral) of FIG. 1 the copy start key (not shown) is operated, the image pickup section starts to read the image from the original (Step S01). The image data picked up from the image of the original by the image pickup section is image processed in the image processing section (not shown) (Step S02) to be stored into the image memory (not shown) (Step S03). This image data is transferred to the image forming control unit (Step S04) where it is transformed into a control-electrode controlling signal (Step S05).

When the image forming control unit has obtained a predetermined amount of the control-electrode controlling signal (Step S06; YES), it controls an unillustrated driving means so as to start toner support 22 (sleeve) of image forming unit 1 rotating (Step S08) and a voltage of −200 V is applied to an unillustrated shield electrode of the control electrode shown in FIG. 3 (Step S09) and then predetermined voltages are applied to opposing electrode 25, charging brush 8 and charge erasing brush 28 shown in FIG. 2 while dielectric belt 24 starts to be moved (Sep S10).

Next, a pickup roller (without numeral) of paper feeder 10 as shown in FIG. 1 is activated (Step S11) so as to supply paper 5 to image forming unit 1 detailedly shown in FIG. 2. This paper 5 is electrified at a voltage in accordance with the differential potential between charging brush 8 and roller 16*a* and conveyed by dielectric belt 24 at a uniform speed above opposing electrode 25. Next, when the paper is normally fed (Step S12; YES), a driving signal is supplied to control electrode 26 (Step S14) whereby toner flow is controlled so as to perform printing (image forming) on paper 5.

Here, when the image forming control unit supplies a control electrode signal to driving circuit 31 shown in FIG. 2 at the timing synchronized with the conveyance of paper 5, driving circuit 31 gives driving signals to the gates of control electrode 26 in accordance with the control electrode signal. As a result, the electric field near the gates of control electrode 26 is controlled in accordance with the driving signal and hence the toner's direction of jumping is controlled in accordance with the image data, thus a toner image (characters) is successively formed on paper 5 which is being conveyed by dielectric belt 24. The paper with the toner image thereon is pressed whilst being heated by fixing unit 11 shown in FIG. 1 so that the toner image is fixed to paper 5. When the printing (the operation of image forming) has been completed in this way (Step S15 ;YES), the operation goes back to Step S01, for preparation of reading a next original.

As described heretofore, in accordance with an image forming apparatus of this type, since the transfer process of the toner image from the developing medium to the paper is omitted, no degradation of image which would occur during the transfer process will occur in contrast to an apparatus using a developing medium such as a photoconductive drum or dielectric drum. Further, since there is no developing medium, this configuration needs fewer number of parts thus making it possible to reduce the size and cost of the apparatus.

Although the above-described image forming apparatus is for producing monochrome images, it is possible to realize a color image forming apparatus for producing color images by providing a plurality of image forming units 1*a*, 1*b*, 1*c* and 1*d* corresponding to, for example, yellow, magenta, cyan and black, as schematically shown in FIG. 6, in place of supplying section 2 shown in FIG. 2.

Driving circuit 31 shown in FIG. 2 for supplying driving signals to control electrode 26 preferably has the characteristic that it will not generate waveform distortion when the driving signal switches. If the driving signal has any waveform distortion, it becomes impossible for control electrode 26 to precisely control toner flow transfer, thus producing degradation of the image. For this reason, a conventional driving circuit for driving the control electrode uses a push-pull configuration in which CMOS drivers each consisting of a pair of p-type and n-type MOS transistors are provided as the output drivers, in order to suppress waveform distortion of the driving signals.

When the aforementioned control electrode shown in FIG. 3 in which the driving signals are applied individually to separate gates is driven, as many output drivers of the aforementioned push-pull type driving circuit as the number of the gates are needed. Suppose, for example, that the image should have a dot density of 300 DPI (dots per inch), 2560 gates are required for A4 sized paper. Accordingly, if the output drivers for the driving circuit are composed of CMOS drivers, each of which consists of two transistors, i.e., p-type and n-type transistors, the transistors needed for constituting the output drivers amounts to 5120, a very large number of transistors.

When the number of the output drivers increases, it becomes difficult to integrate them in one LSI chip due to problems of output noise, power consumption (heat generation) and mounting into the package. Therefore, the driving means is divided into a plurality of LSIs. In general, a driving circuit is embodied with LSIs which each are mounted in a QFP (quad flat package) having 64 channels (64 output drivers). When a control electrode having 2560 gates needs to be controlled as stated above, driving circuit 31 is composed of 40 of these LSIs.

In the above way, even when the driving circuit using a push-pull configuration is composed of divided 64-channel LSIs, each LSI has 64 output drivers mounted thereon and further needs additional circuits such as shift resistors, latches etc., increasing its chip size and hence its cost. Further, since the driving circuit is composed of plural LSIs, even more parts are needed further increasing the size of the device.

As well as the driving circuit of the push-pull type, there is another configuration of a driving circuit which uses pull-up resistance. This driving circuit is composed of a high-voltage power source 185 and a low voltage power source 184, and a resistance element 183 as pull-up resistance and a transistor 188 in series connected between the two power sources. In this arrangement, the switching state of transistor 188 is controlled by an image signal controlling circuit 86 so as to selectively output one voltage of high-voltage power source 185 or low-voltage power source 184 (for example, +150 V or −200 V) to the output terminal as the driving signal level in accordance with the image signal.

In a driving circuit of this type, the transistors needed are approximately half as many as those used in a driving circuit of the aforementioned push-pull configuration, thus making it possible to reduce the circuit scale. This circuit configuration, however, is liable to cause waveform distortion since one of its driving signal output levels is defined using pull-up resistance as a passive element. It is possible to suppress waveform distortion to some degree if the current is increased by reducing the resistance value of the pull-up resistor, though the power consumption increases and hence counter measures against heat are needed, resultantly increasing the cost.

If the driving signal for driving the control electrode shows any waveform distortion, various problems occur as follows. If, for example, the potential of gate 29 of control electrode 26 shows any waveform distortion in the driving signal when the signal changes into the voltage for making toner pass, the distribution of the electric field will not change at the intended timing, causing a time lag for toner jumping. For this reason, the pulse width of the driving signal for controlling toner jumping must be set longer, this needing a longer time for creating a single dot and hence lowering the image forming speed. Conversely, if the potential of gate 29 shows a waveform distortion when the signal changes into the voltage of prohibiting toner from passing through it, a time lag occurs until the transfer of toner stops. Resultantly, the dot formed shows a tail, degrading the quality of image.

In a matrix type control electrode as shown in FIG. 4, it is impossible to totally stop toner jumping. This means leakage of toner causing background fogginess in the image. Even though dots have a high enough density, if this phenomenon occurs it is impossible to inhibit toner from adhering to the background (non-toner area). As a result, the image becomes blurred, low in contrast and low in reproducible performance of halftones, or low in color reproducibility in the case of a color image.

Further, in the case where no paper is conveyed over the opposing electrode, the toner leaked through the control electrode adheres to the opposing electrode surface. In this state if a sheet of paper is conveyed over the opposing electrode, the rearside of the paper will be stained. Further, in this case, the distribution of the potential across the opposing electrode varies due to the adhering toner, affecting the jumping path of the toner and hence making it impossible to precisely control the toner jumping.

Moreover, if the toner adheres to the interior of a gate due to waveform distortion in the driving signal, the apparent potential of the gate varies to thereby disrupt the distribution of the electric field nearby. As a result, the jumping path of the toner is perturbed, causing image failures such as partial image defect and the like.

In the conventional driving circuit of a control electrode, in order to optimally suppress its dc loss, a complementary output configuration is used which needs on its high side a high-side switch (level shifter) for turning on and off its high-voltage active element whilst suppressing d.c. loss. A capacitor, which is a passive element, is used for this purpose.

FIG. 9 is an IC diagram showing a typical complementary configuration. In this complementary IC, the source of a p-channel MOS FET 704 is connected to a high-voltage power source 51 and the source of an n-channel MOS FET 705 is connected to a low-voltage power source 52. These are selectively turned on and off so as to output a voltage from high-voltage power source 51 or low-voltage power source 52.

A p-channel MOS FET ON/OFF control signal 600 generated in the internal timing generating circuit is supplied to the gates of field effect transistors connected to a logic power source 50, namely the gates of p-channel MOS FET 700 and n-channel MOS FET 701 while their outputs are connected to the gate of a p-channel MOS FET 704 via a level shifter capacitor 300. Parallel circuitry of a resistance element 301 and a Zener diode 302 is connected to a high-voltage power source 51 and the gate of FET 704, and functions as a bias element for p-channel MOS FET 704. An n-channel MOS FET ON/OFF control signal 601 is supplied to the gates of field effect transistors, namely p-channel MOS FET 702 and n-channel MOS FET 703 while their outputs are connected to the gate of an n-channel MOS FET 705.

The driving state will be explained hereinbelow.

Now, when control signal 601 is set at the low level, p-channel MOS FET 705 is turned on so that output 500 supplies the voltage from low-voltage power source 52. In this state, control signal 600 stays at the low level while the drain output from MOS FETs 700/701 is at the high level. The absolute voltage of the gate of p-channel MOS FET 704 which is connected to the level shifter capacitor is biased by resistance element 301, being set equal to the voltage of high-voltage power source 51. As a result, the gate voltage (VGS) of p-channel MOS FET 704 becomes 0 V. Therefore, p-channel MOS FET 704 stays in the OFF state so that no short-circuit occurs between p-channel MOS FET 704 and n-channel MOS FET 705.

Next, control signal 601 is changed from HIGH to LOW at time P1 as shown in FIG. 10 so as to turn off n-channel MOS FET 705. Thereafter, at time P2, control signal 600 is changed from LOW to HIGH. At this moment, a voltage V1 arises at the gate of p-channel MOS FET 704. This voltage V1 is a voltage which is obtained by subtracting the changing voltage of the output from transistors 700/701 via level shift capacitor 300, from the voltage of high-voltage power source 51.

This generates gate-source voltage VGS of p-channel MOS FET 704, so that p-channel MOS FET 704 is turned on, outputting the voltage of high-voltage power source 51 at its output. The voltage appearing at the gate of p-channel MOS FET 704 will not be maintained for a long period of time at the same level because charging is effected via resistance element 301. This time is dependent upon resistance element 301 and level shifter capacitor 300.

Next, in order to turn off p-channel MOS FET 704, control signal 600 is changed from HIGH to LOW at time P3. At this moment, the potential difference between the gate voltage of p-channel MOS FET 704 and the voltage of the high-voltage power source is V2, and when the change of transistors 700/701 is added, the gate voltage transits from this level to a level which is greater by V3 than the voltage of the high-voltage power source. This voltage causes the Zener diode to allow forward flow of current so that the gate voltage of p-channel MOS FET 704 is reset to the voltage of high-voltage power source 51 and thus it is turned off.

Then, at time P4, control signal 600 is changed from HIGH to LOW. This activates n-channel MOS FET 705, and the voltage of the low-voltage power source appears at output 500. Thus, a driving pulse defined by the voltage of the low-voltage power source and the voltage of the high-voltage power source can be generated at output 500.

In the high-voltage power source circuit and IC, a level transforming configuration using a pull-up resistor 310 as shown in FIG. 11 has been employed to control the transistor in the high-voltage side. In this configuration, when the switching speed is attempted to be increased, the value of resistor 310 needs to be set smaller. But, this makes its dc loss greater, causing a higher degree of heat from the resistance and increasing the load on the power source, resulting in unsuitability for IC configuration. On the other hand, if the value of resistor 310 is made grater, the switching speed becomes lower. This is why the aforementioned configuration shown in FIG. 9 is generally used.

The circuit configuration shown in FIG. 9, however, needs a couple of output transistors 704 and 705 for each circuit, and to individually control these transistors further needs buffer transistors 700, 701, 702 and 703, level shifter capacitor 300, pull-up resistor 301 and Zener diode 302. Moreover, level shifter capacitor 300 is required to be resistant to high voltage and of high capacitance because this capacitance determines the driving time in combination with resistance 301.

FIG. 12 shows a configuration in which a number of ICs shown in FIG. 9 are integrated. Each high-voltage resistant capacitor 300-1 to 300-n needs a certain distance between its electrodes and the total capacitance needs a certain defined area. As a result, the chip area becomes very large. Further, a p-channel MOS FET has a greater area compared to an n-channel MOS FET. If, for example, an integrated circuit having 64 channels is configured, this configuration needs 64 capacitors and 24 output transistors, increasing its chip area and hence the cost.

SUMMARY OF THE INVENTION

The present invention has been devised in view of the above problems and it is therefore an object of the present invention to provide a driving circuit for a control electrode equipped in an image forming apparatus, which can be configured in a minimum scale and still will not generate waveform distortion in the driving signal.

It is another object of the invention to provide a driver IC which is markedly reduced in its IC chip area when it is integrated and hence inexpensive.

The present invention is a driving circuit for a control electrode for controlling the jumping of the developer provided in an image forming apparatus which creates an image by making the developer jump by electric force, and is configured as follows:

In accordance with the first aspect of the invention, a driving circuit for a control electrode for controlling the jumping of the developer provided in an image forming apparatus which creates an image by making the developer jump by electric force, includes:

a first semiconductor switch with its source connected to a high-voltage power source;

a plurality of diodes with their anodes commonly connected to the drain of the first semiconductor switch; and a plurality of second semiconductor switches, each being connected at the drain to the cathode of the corresponding diode and the sources being commonly connected to a low-voltage power source, and is characterized in that the first semiconductor switch is turned on at a point of time as a reference point for driving the control electrode and turned off after the lapse of the first period of time and selected part of the plural second semiconductor switches is turned off from the same point of time and turned on after the lapse of the second period of time while the remaining part is turned off from the same point of time and then turned on after the lapse of the third period of time so as to output to the control electrode, the voltage which is supplied from the high-voltage power source or from the low-voltage power source and appears on the drain side of the second semiconductor switches, and the second period is longer than the first period and shorter than the third period.

In accordance with the second aspect of the invention, a driving circuit for a control electrode for controlling the jumping of the developer provided in an image forming apparatus which creates an image by making the developer jump by electric force, includes:

a plurality of first semiconductor switches with their sources connected to a high-voltage power source;

a plurality of diodes each of which is connected at its anode to the drain of one of the plural first semiconductor switches; and a plurality of second semiconductor switches, each being connected at the drain to the cathode of the corresponding diode and the sources being connected to a low-voltage power source, and is characterized in that the first semiconductor switches are turned on at a point of time as a reference point for driving the control electrode and turned off after the lapse of the first period of time and selected part of the plural second semiconductor switches is turned off from the same point of time and turned on after the lapse of the second period of time while the remaining part is turned off from the same point of time and then turned on after the lapse of the third period of time so as to output to the control electrode, the voltage appearing on the drain side of the second semiconductor switches, and the second period is longer than the first period and shorter than the third period.

In accordance with the third aspect of the invention, a driving circuit for a control electrode for controlling the jumping of the developer provided in an image forming apparatus which creates an image by making the developer jump by electric force, includes:

a first semiconductor switch with its source connected to a high-voltage power source;

a plurality of diodes each of which is connected at its anode to the drain of the first semiconductor switch; and a plurality of second semiconductor switches, each being connected at the drain to the cathode of the corresponding diode and the sources being connected to one of plural low-voltage power sources, and is characterized in that the first semiconductor switch is turned on at a point of time as a reference point for driving the control electrode and turned off after the lapse of the first period of time and selected part of the plural second semiconductor switches is turned off from the same point of time and turned on after the lapse of the second period of time while the remaining part is turned off from the same point of time and then turned on after the lapse of the third period of time so as to output to the control electrode, the voltage appearing on the drain side of the second semiconductor switches and the second period is longer than the first period and shorter than the third period.

In accordance with the fourth aspect of the invention, a driving circuit for a control electrode for controlling the jumping of the developer provided in an image forming apparatus which creates an image by making the developer jump by electric force, comprising:

a plurality of first semiconductor switches with their sources connected to one of plural high-voltage power sources;

a plurality of diodes each of which is connected at its anode to the drain of one of the plural first semiconductor switches; and a plurality of second semiconductor switches, each being connected at the drain to the cathode of the corresponding diode and the sources being connected to a single low-voltage power source or a plurality of low-voltage power sources, and is characterized in that the first semiconductor switches are turned on at a point of time as a reference point for driving the control electrode and turned off after the lapse of the first period of time and selected part of the plural second semiconductor switches is turned off from the same point of time and turned on after the lapse of the second period of time while the remaining part is turned off from the same point of time and then turned on after the lapse of the third period of time so as to output to the control electrode, the voltage appearing on the drain side of the second semiconductor switches, and the second period is longer than the first period and shorter than the third period.

In accordance with the fifth aspect of the invention, the driving circuit for a control electrode provided in an image forming apparatus having the above third configuration is characterized in that the plural low-voltage power sources supply different voltages from one another.

In accordance with the sixth aspect of the invention, the driving circuit for a control electrode provided in an image forming apparatus having the above fourth configuration is characterized in that the plurality of high-voltage power sources or the plurality of low-voltage power sources supply two or more levels of voltage.

In accordance with the seventh aspect of the invention, the driving circuit for a control electrode provided in an image forming apparatus having the above first configuration is characterized in that a capacitance element is connected to the drain side of each of the plural second semiconductor switches.

In accordance with the eighth aspect of the invention, the driving circuit for a control electrode provided in an image forming apparatus having the above first configuration is characterized in that the first period is longer than the time required for the output level of the potential appearing at the output to be saturated to the level of voltage of the high-voltage power source and the second period is shorter than the time span from when the voltage of the high-voltage power source appears on the control electrode until the toner is allowed to jump.

In accordance with the ninth aspect of the invention, the driving circuit for a control electrode provided in an image forming apparatus having the above first configuration is characterized in that the first and second semiconductor switches are of p-type and n-type field effect transistors, respectively.

In accordance with the tenth aspect of the invention, the driving circuit for a control electrode provided in an image forming apparatus having the above first configuration is characterized in that the first semiconductor switch is of a p-type field effect transistor and the second semiconductor switches are of a n-p-n type transistor.

In accordance with the eleventh aspect of the invention, the driving circuit for a control electrode provided in an image forming apparatus having the above first configuration is characterized in that the first semiconductor switch is of a p-type field effect transistor and the second semiconductor switches are of a thyristor.

In accordance with the twelfth aspect of the invention, the driving circuit for a control electrode provided in an image forming apparatus having the above first configuration is characterized in that the first semiconductor switch commonly connected to the anode side of the plural diodes is set outside the integration.

In accordance with the thirteenth aspect of the invention, the driving circuit for a control electrode provided in an image forming apparatus having the above first configuration is characterized in that a driving circuit for driving the first semiconductor switch commonly connected to the anode side of the plural diodes is put inside the integration.

In accordance with the fourteenth aspect of the invention, the driving circuit for a control electrode provided in an image forming apparatus having the above first configuration, further includes a driving circuit which is connected via a capacitor to gates of the first semiconductor switch commonly connected to the anode side of the plural diodes, and is characterized in that the capacitor is set outside the integration.

The thus configured present invention operates as follows.

In the driving circuit for a control electrode equipped in an image forming apparatus in accordance with the first or seventh to fourteenth feature of the invention, the first conductivity type transistor is turned on during the first period and then is turned off after this period. Partial second conductivity type transistors are turned off during the second period and then are turned on after this period. Further, the remaining second conductivity type transistors are turned off during the third period and then is turned on after this period. Accordingly, in the third period after the lapse of the second period, the partial second conductivity type transistors output the voltage from the low-voltage power source at the their drain while the remaining second conductivity type transistors are maintained to output the voltage from the high-voltage power source at their drain side.

In the driving circuit for a control electrode equipped in an image forming apparatus in accordance with the second or seventh to fourteenth feature of the invention, the plural first conductivity type transistors are turned on during the first period and then are turned off after this period. Partial second conductivity type transistors are turned off during the second period and then are turned on after this period. Further, the remaining second conductivity type transistors are turned off during the third period and then are turned on after this period. Accordingly, in the third period after the lapse of the second period, the partial second conductivity type transistors output the voltage from the low-voltage power source at the their drain while the remaining second conductivity type transistors are maintained to output the voltage from the high-voltage power source at their drain side. In this case, the high voltage appearing on the drain of the remaining second conductivity type transistors is supplied by way of one of the plural first conductivity type transistors.

In the driving circuit for a control electrode equipped in an image forming apparatus in accordance with the third, fifth or seventh to fourteenth feature of the invention, the first conductivity type transistor is turned on during the first period and then is turned off after this period. Partial second conductivity type transistors are turned off during the second period and then are turned on after this period. Further, the remaining second conductivity type transistors are turned off during the third period and then are turned on after this period. Accordingly, in the third period after the lapse of the second period, the partial second conductivity type transistors output the voltage from the low-voltage power source at the their drain while the remaining second conductivity type transistors are maintained to output the voltage from the high-voltage power source at their drain side. In this case, the low voltage appearing on the drain of 'the partial second conductivity type transistors' is supplied from one of the voltages from the plural low-voltage power sources.

In the driving circuit for a control electrode equipped in an image forming apparatus in accordance with the fourth, sixth or seventh to fourteenth feature of the invention, the plural first conductivity type transistors are turned on during the first period and then is turned off after this period. Partial second conductivity type transistors are turned off during the second period and then are turned on after this period. Further, the remaining second conductivity type transistors are turned off during the third period and then are turned on after this period. Accordingly, in the third period after the lapse of the second period, 'the partial second conductivity type transistors' output the voltage from the low-voltage power source at the their drain while 'the remaining second conductivity type transistors' are maintained to output the voltage from the high-voltage power source at their drain side. In this case, the high voltage being maintained on the drain of 'the remaining second conductivity type transistors' is of one of the voltages from the plural high-voltage power sources being connected to respective first conductivity type transistors.

In accordance with the driving circuit for a control electrode equipped in an image forming apparatus in accordance with the seventh feature of the invention, the high voltage maintained on the drain of 'the remaining second conductivity type transistors' is charged during the first period. Then, after the first conductivity type transistor has been turned off after the lapse of this first period, the voltage will be stably maintained by the capacitance element.

In accordance with features of the first to eleventh features of the invention, the level shifter circuit components and buffer transistors etc. which were needed in the conventional art are not needed, thus it is possible to markedly reduce the number of parts and hence reducing the chip area of the IC when it is integrated.

In accordance with the twelfth feature of the invention, since in an IC having a large number of outputs, the current flowing through the first semiconductor switch is large and generates a great amount of heat, this switch is provided outside the integration, thus preventing the heat generation of the chip as well as easily making the package compact.

In accordance with the thirteenth feature of the invention, when the current flowing through the first semiconductor switch is within the range allowed by the package, one-chip control can be performed which needs few external parts and makes it possible to make the device compact.

In accordance with the fourteenth feature of the invention, since the capacitance for the level shifter which needs a large integration (IC) area is set outside the integration, it is possible to minimize the chip area of the IC.

DESCRIPTION OF THE PREFERRED EMBODIMENTS

Figure 1:
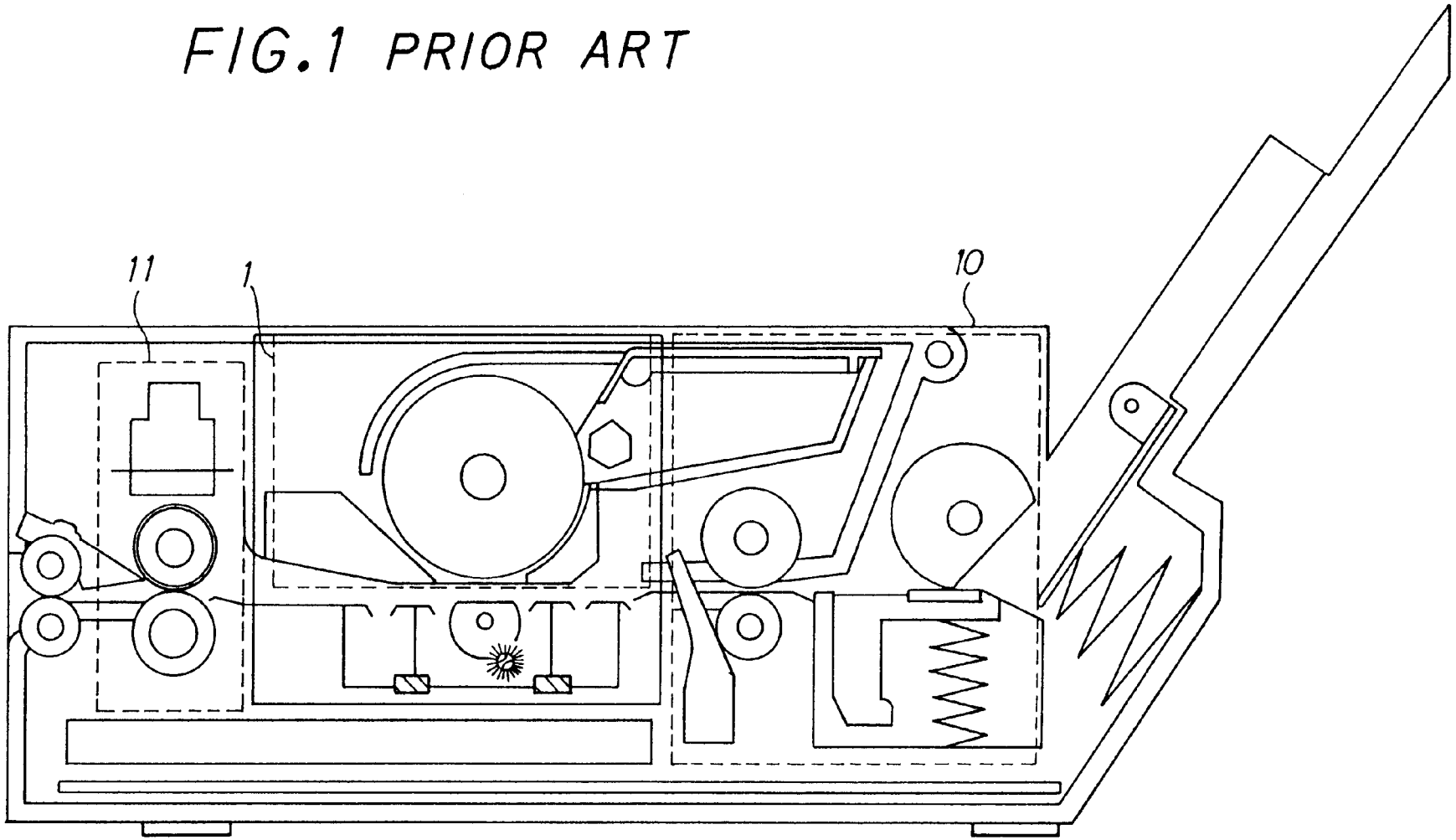
FIG. 1 PRIOR ART
FIG. 1 is a schematic sectional view showing a digital copier.

The embodiments of the invention will hereinafter be described in detail with reference to FIGS. 13 to 21. In these figures, the same components or corresponding components are allotted with the same reference numerals, and description will be not be repeated.

(1st embodiment)

First, referring to FIGS. 13 to 17, description will be made of a driving circuit for a control electrode equipped in an image forming apparatus in accordance with the first embodiment of the invention. In the following description, a driving circuit having 64 channel outputs and outputting +150 V or −200 V as the driving signal levels is exemplified, but the number of channels and the driving signal levels are not particularly limited.

Figure 2:
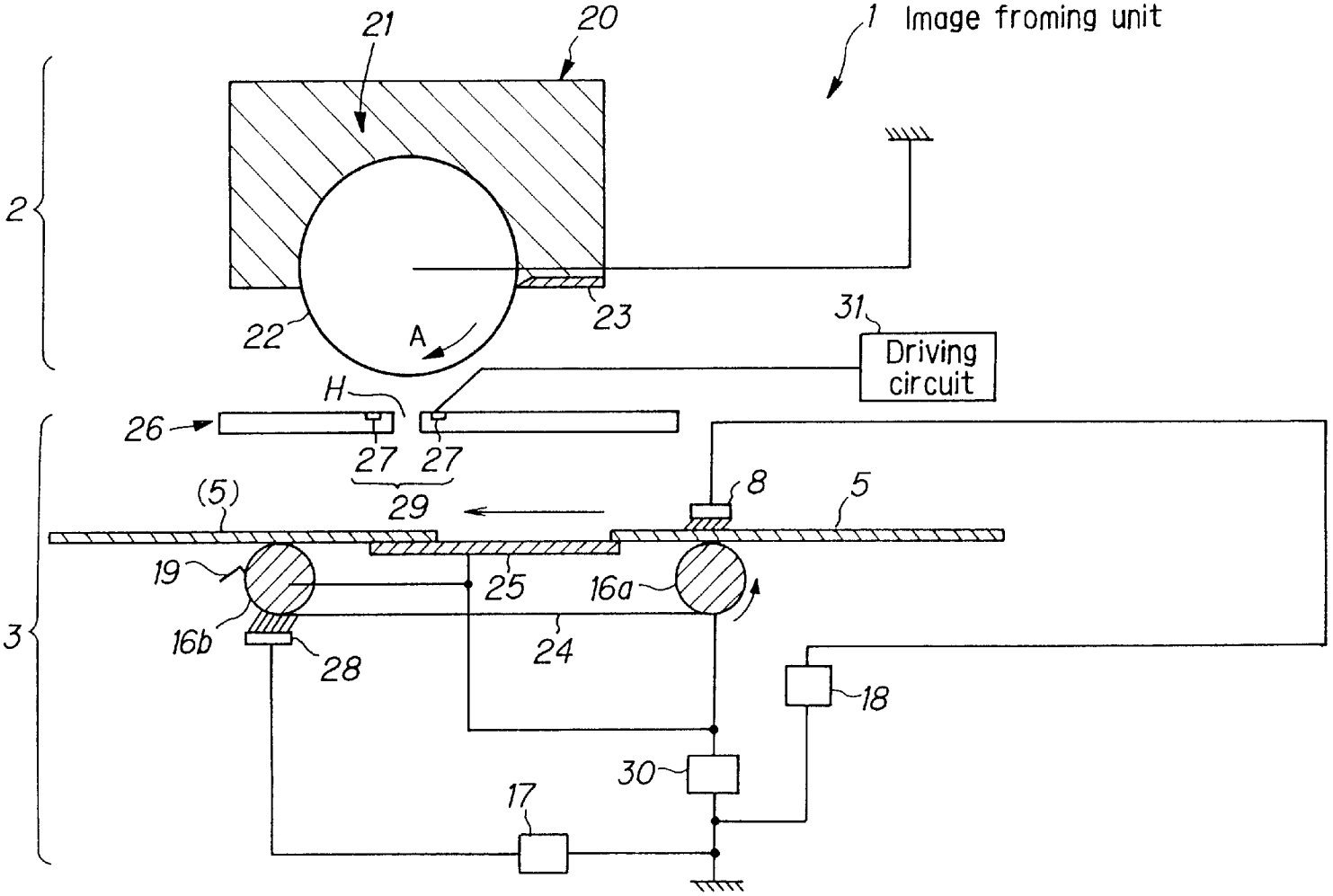
FIG.2 PRIOR ART
FIG. 2 is a diagram showing the configuration of an image forming unit of a digital copier.
Figure 3:
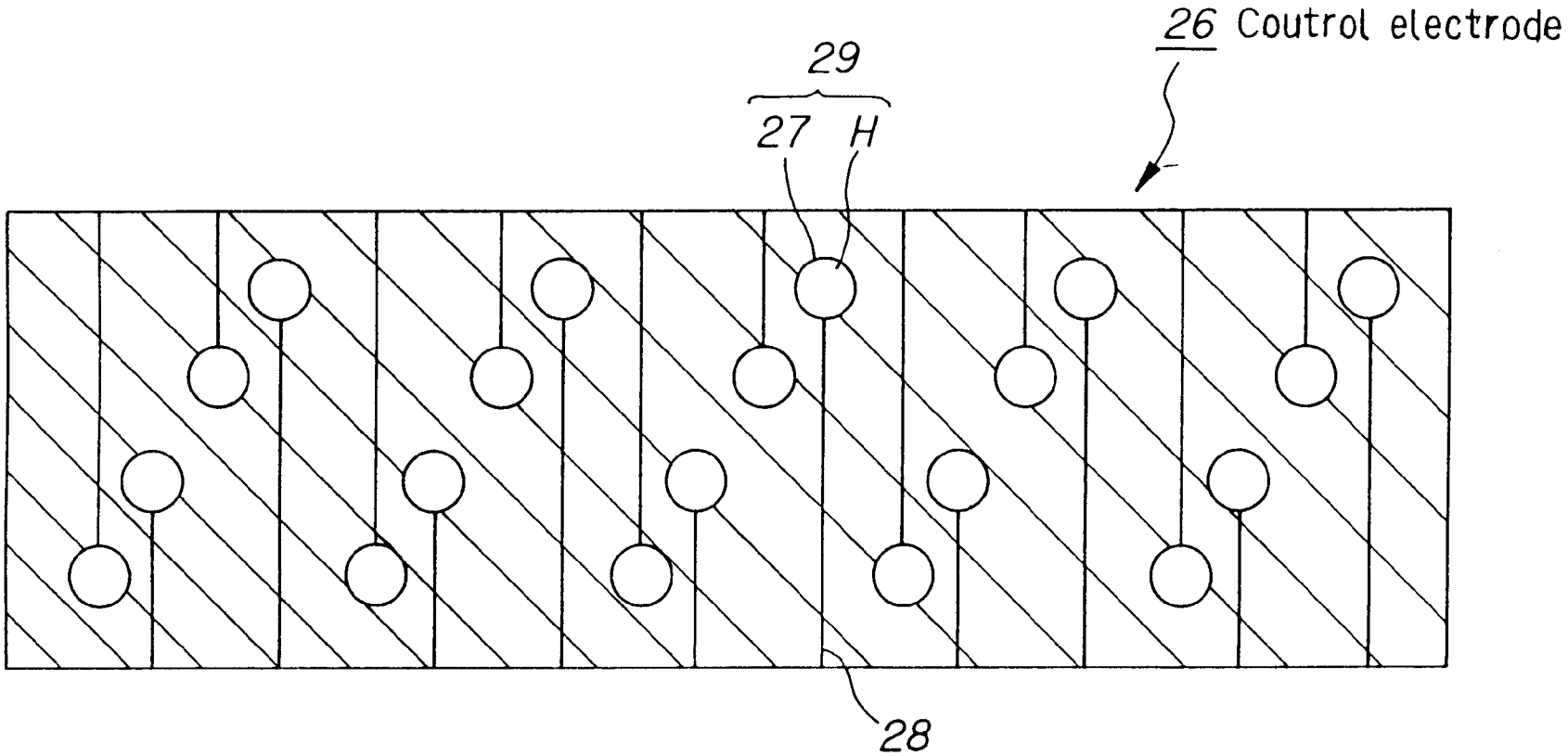
FIG. 3 PRIOR ART
FIG. 3 is a top view of a control electrode.
Figure 4:
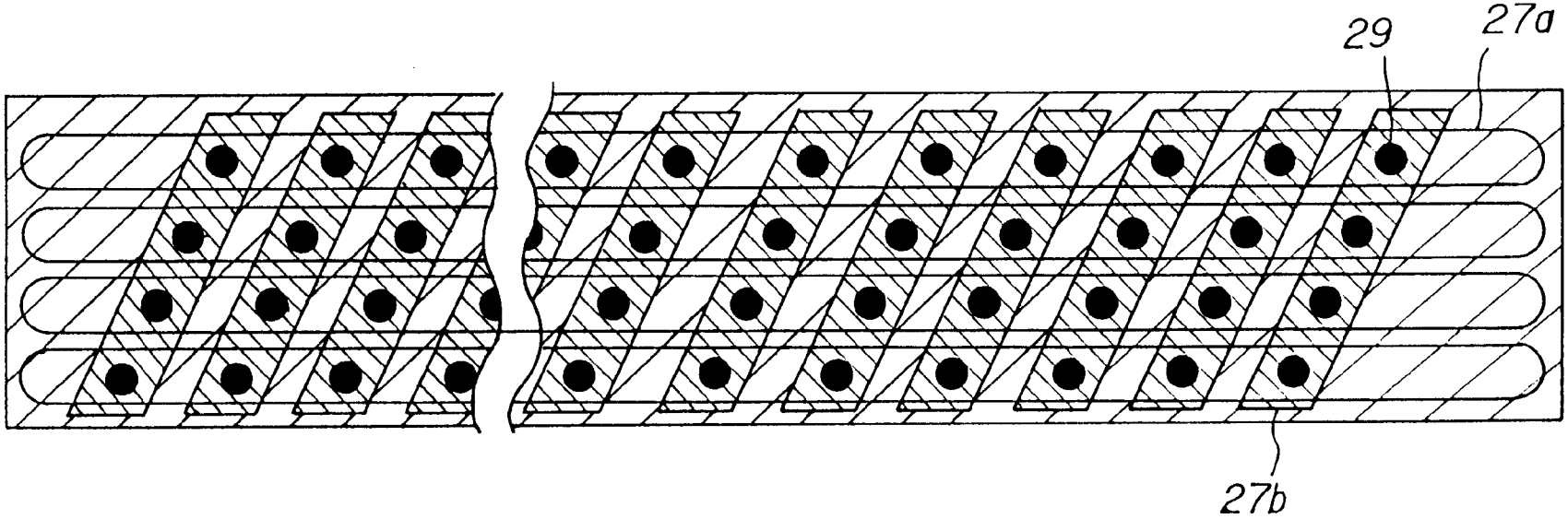
FIG. 4 PRIOR ART
FIG. 4 is a top view of a matrix type control electrode.
Figure 5:
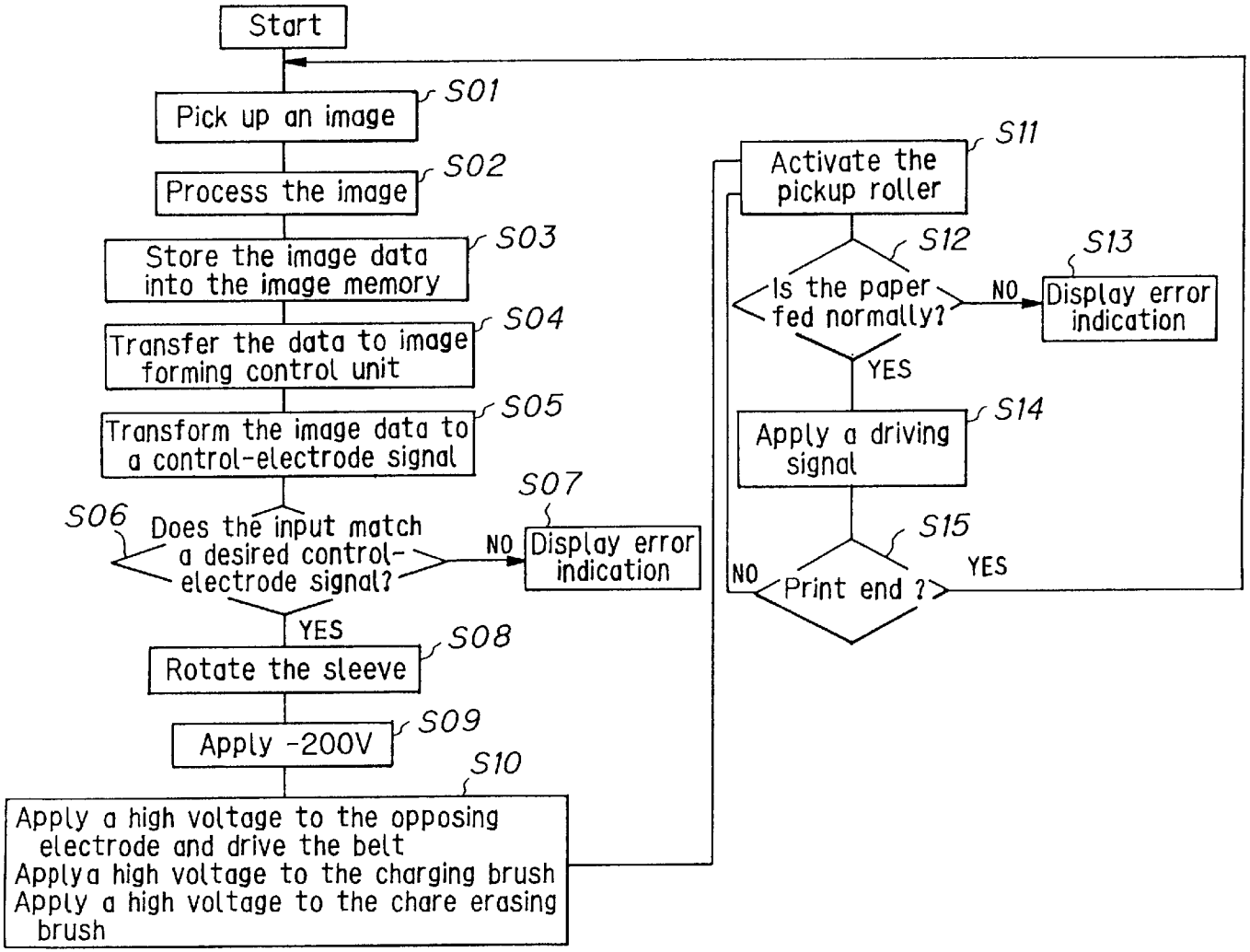
FIG. 5 PRIOR ART
FIG. 5 is a flowchart for explaining the copying operation of a digital copier.
Figure 6:
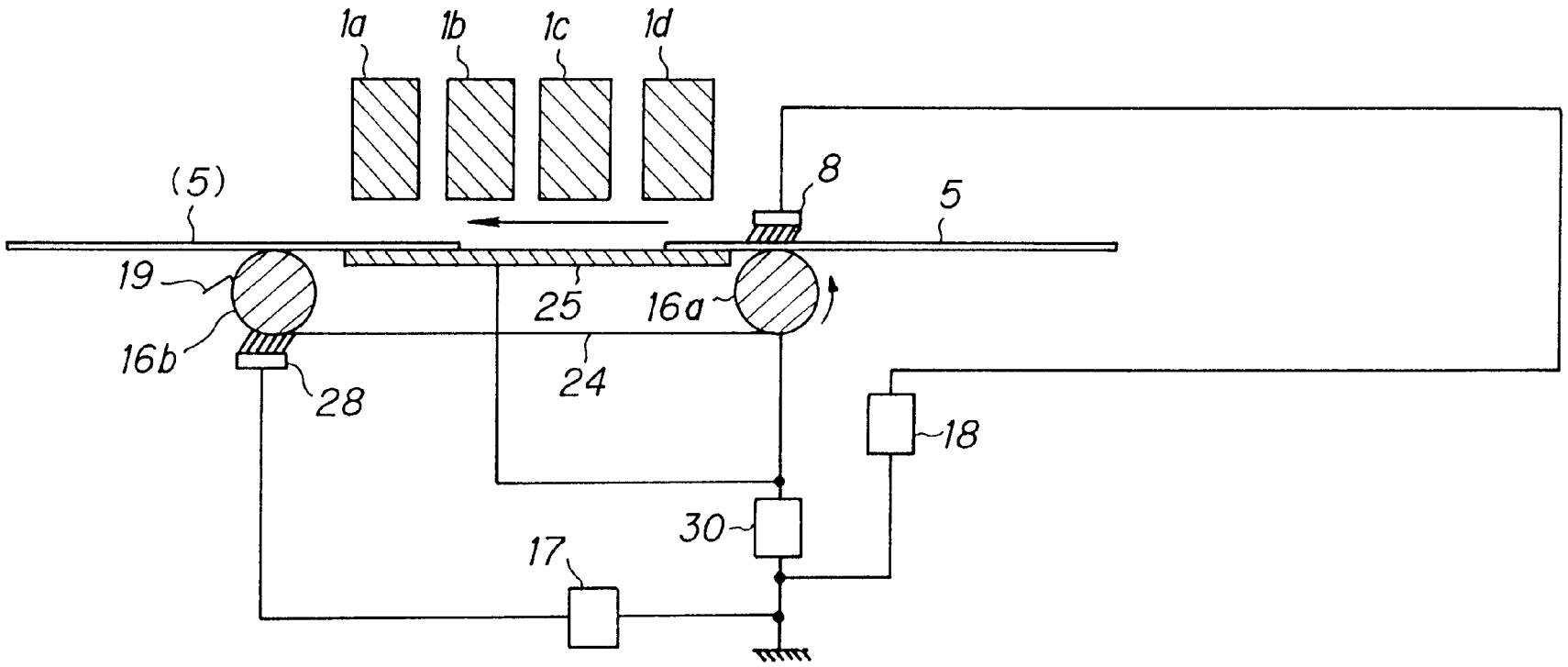
FIG. 6 PRIOR ART
FIG. 6 is a diagram showing the configuration of an image forming unit of a color image forming apparatus.
Figure 7:
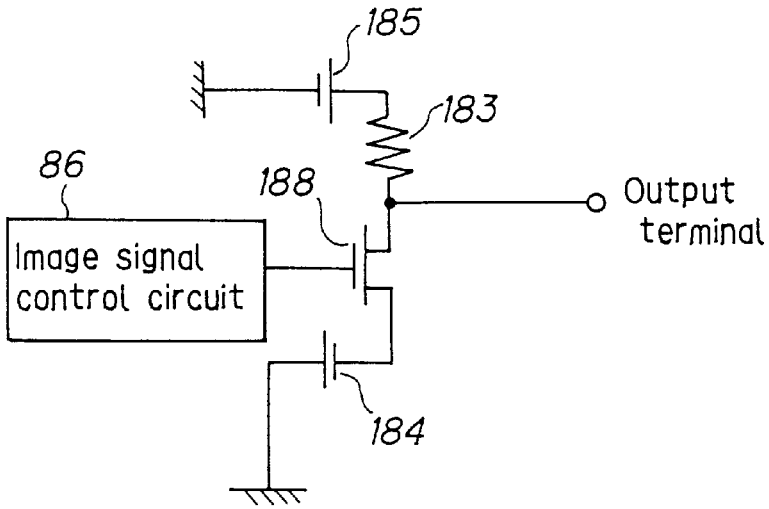
FIG. 7 PRIOR ART
FIG. 7 is a diagram showing the configuration of a driving circuit using a pull-up resistor.
Figure 8:
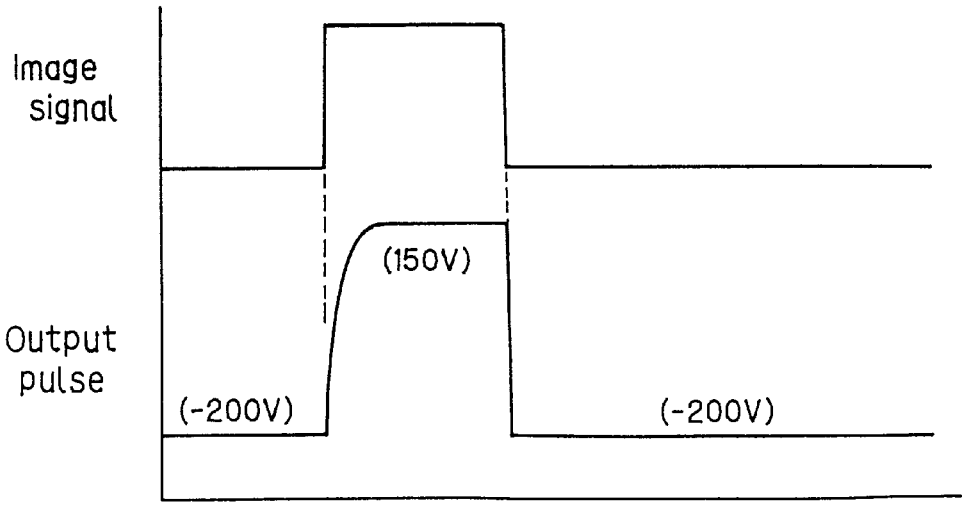
FIG. 8 PRIOR ART
FIG. 8 is a waveform chart for explaining the operation of a driving circuit using a pull-up resistor.
Figure 13:
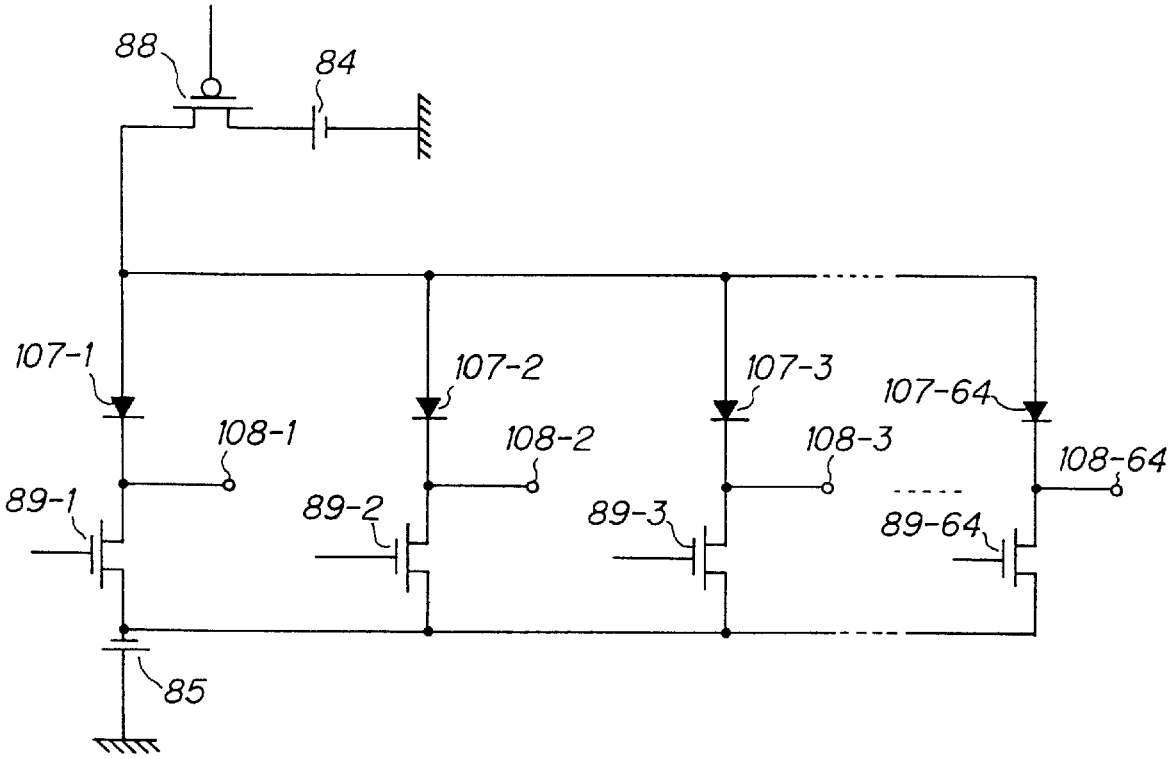
FIG. 13 is a circuit diagram showing a driving circuit in accordance with the first embodiment of the invention.

The driving circuit for a control electrode in accordance with the embodiment shown in FIG. 13 is composed of a p-type field effect transistor 88 (the 1st semiconductor switch) with its source connected to a high-voltage power source 84 of 150 V; a plurality of diodes 107-1 to 107-64 with their anodes commonly connected to the drain of the aforementioned transistor 88; and a plurality of n-type field effect transistors 89-1 to 89-64 (a plurality of 2nd semiconductor switches) with their drains connected to respective cathodes of diodes 107-1 to 107-64 and their sources commonly connected to a low-voltage power source 85 of −200 V. The drain of the transistors 89-1 to 89-64 (or the cathode sides of diodes 107-1 to 107-64) are connected to output terminals 108-1 to 108-64, respectively. These output terminals 108-1 to 108-64 are connected to individual feed lines 27 of control electrode 26 shown in FIG. 2 so that either the voltage from high-voltage power source 84 (+150 V) or from low-voltage power source 85 (−200 V) is selected and applied to each gate 29 as the potential of the driving signal.

Referring now to the timing chart shown in FIG. 14, the operation of the driving circuit shown in FIG. 13 will be described hereinbelow. In the description, only output terminals 108-1 to 108-3 will be mentioned and the other output terminals will not be referred to since their operations are the same.

First, description will be made of the case where terminal 108-1 first outputs +150 V (whilst output terminals 108-2 and 108-3 output −200 V) and then output terminal 108-2 outputs +150 V (whilst output terminals 108-1 and 108-3 output −200 V).

In the initial state, it is assumed that transistor 88 is in the off state and transistors 89-1 to 89-3 are in the on state. In this case, the voltage of power source 85 (−200 V) appears as the driving signal level at output terminals 108-1 to 108-3 via transistors 89-1 to 89-3. Next, transistor 88 is activated at time t1 which is a reference point for driving the control electrode. At this moment, time t1, transistors 89-1 to 89-3 are simultaneously deactivated because it is necessary to avoid high-voltage power source 84 and low-voltage power source 85 being short-circuited. As a result, the voltage of high-voltage power source 84 (+150 V) appears at output terminals 108-1 to 108-3 via the corresponding diode (107-1 to 107-3) and transistor 88.

Next, transistor 88 is deactivated at time t2, thereafter, transistors 89-2 and 89-3 are turned on at time t3 whilst transistor 89-1 stays off. This causes output terminals 108-2 and 108-3 to output the voltage of low-voltage power source 85 (−200 V) via respective transistors 89-2 and 89-3. At this moment, transistor 89-1 is maintained in the off state, so that output terminal 108-1 is maintained by parasitic capacitance, at the voltage (+150 V) which was given from high-voltage power source 84. Next, when transistor 89-1 is turned on at time t4, the voltage of low-voltage power source 85 (−200 V) also appears at output terminal 108-1, so that the potentials at all the output terminals revert back to the initial state.

To sum up, transistor 88 is turned on during period T1 from time t1 to time t2 (the 1st period), and then it is turned off after the lapse this period (T1). Transistors 89-2 and 89-3 (partial 2nd switches) are turned off during period T2 from time t1 to t3 (the 2nd period), and then they are turned on after the lapse of this period (T2). Further, transistor 89-1 is turned off during the period from time t1 to t4 (the 3rd period), and then it is turned on after the lapse of this period (T3). Here, period T2 (the 2nd period) from time t1 to t3 is set longer than period T1 (the 1st period) from time t1 to t2, and is set shorter than period T3 (the 3rd period) from time t1 to t4.

Thus, by controlling switching of each transistor as above, the voltage from high-voltage power source 84 (+150 V) appears only at output terminal 108-1 during the period from time t3 to time t4 while the voltage from low-voltage power source 85 (−200 V) selectively appears at the other terminals. Accordingly, during this period, the driving circuit controls the control electrode by applying +150 V to the control electrode gate which is connected to output terminal 108-1 so that negatively charged toner selectively passes through the gate.

However, during period T2 from t1 to t3, +150 V appears at all the output terminals so that all the gates become able to allow passage of toner regardless of the image signal. If toner passes through the gates whatever the image signal is, the forming image will be partially blotted, producing image failure.

To deal with this, periods T1 and T2 will be controlled in the following manner.

First, period T1 in which transistor 88 is on, requires as a minimum, time to allow the potential of each output terminals 108-1 to 108-3 to stabilize to the voltage of power source 88 (150 V). On the other hand, since there is a need to avoid short-circuit between the power sources as already stated above, period T2 in which transistors 89-1 to 89-3 are turned off cannot be set shorter than period T1 in which transistor 88 is made conductive. As understood from the characteristic chart shown in FIG. 15, the image dot size corresponding to the pulse width of the driving signal (corresponding to time t3 minus time t1) is almost zero, i.e., no toner jumps when this pulse width is equal to about 30 μsec or less.

Figure 14:
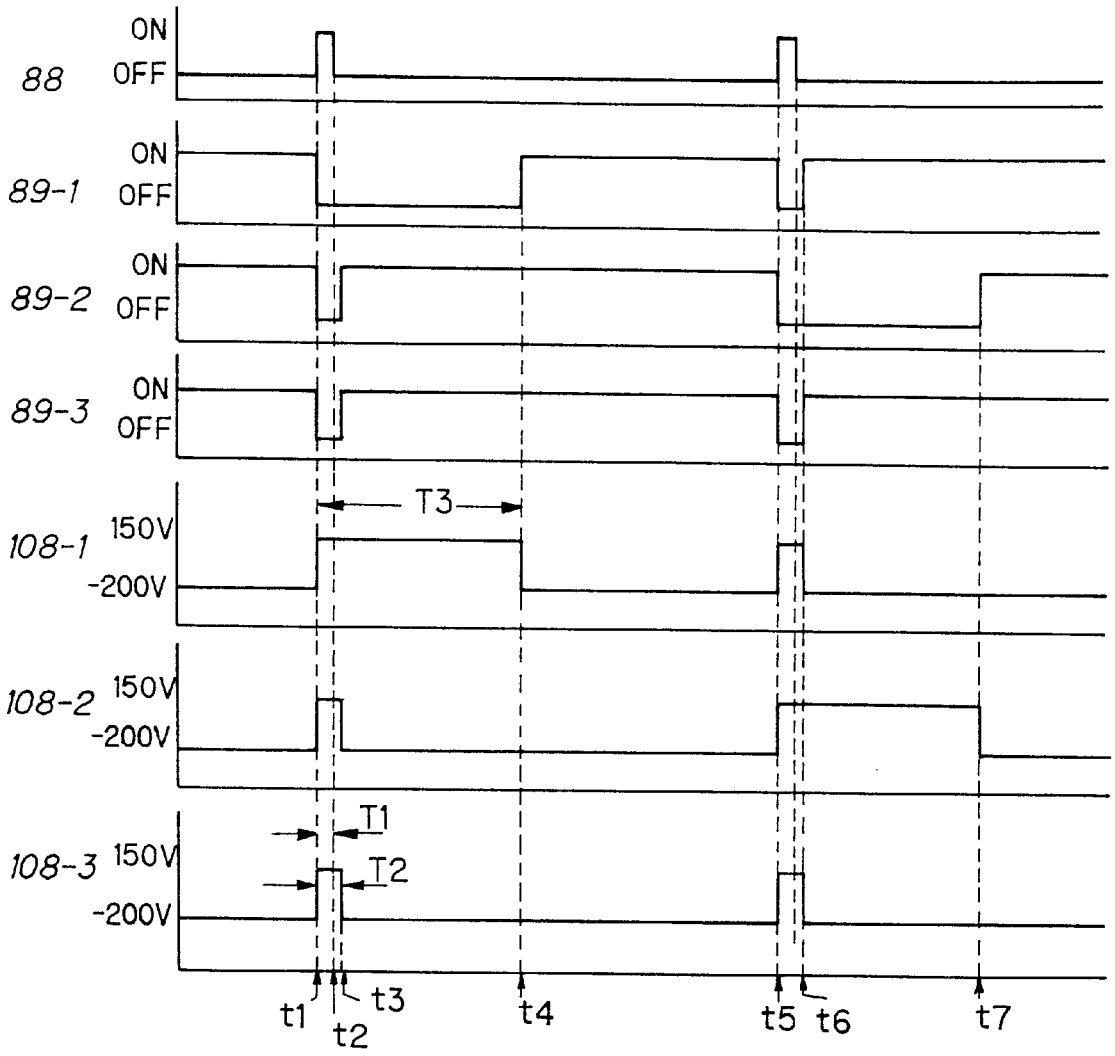
FIG. 14 is a timing chart for explaining an operating manner of the driving circuit in accordance with the first embodiment of the invention.
Figure 15:
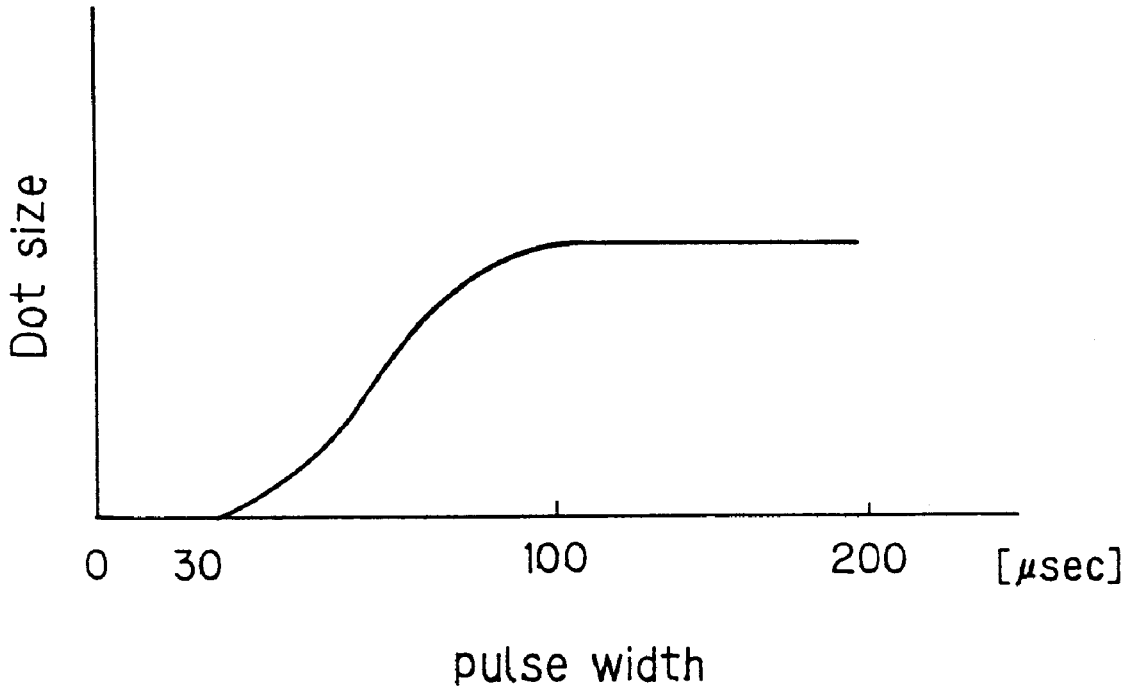
FIG. 15 is a characteristic chart showing the relationship between the pulse width for making the toner jump and the dot size in the resultant image.

From this fact, in FIG. 14, as long as period T1 is equal to 30 μsec or less, even if all the gates have the voltage of high-voltage power source 84 (+150) applied thereto, no toner jumps, and hence no blotting of the image. Referring to this feature, periods T1, T2 and T3 shown in FIG. 14, may be set at, for example, 15 μsec, 25 μsec and 200 μsec respectively.

As stated above, period T1 depends on the charging time for parasitic capacitance of the output terminal. This charging time is by far shorter than 15 μsec, so in this case, charging can be performed with enough speed. Therefore, it is possible to set this period T1 shorter, but the value of the parasitic capacitance may vary due to the influence of the service environment (temperature and/or humidity). In such a case, if the time allotted for charging is short, the charged potential (the driving signal level) fluctuates. Therefore, it is preferred that the time is set long enough but within the range where no image blotting occurs, to allow the output potential (charged potential) to be saturated even when the parasitic capacitance may vary.

Next, description will be made of a case where output terminal 108-2 alone outputs +150 V. In this case, in a similar manner as above, transistor 88 is activated at time t5 which is a reference point for the operation shown in FIG. 14, and at the same time, transistors 89-1 to 89-3 are deactivated so that all the output terminals output the voltage from high-voltage power source 84 (+150 V). Thereafter, transistor 88 is deactivated. Then, at time t6, transistors 89-1 and 89-3 are turned on, whilst transistor 89-2 stays off. After a certain time, at time t7, transistor 89-2 is also turned on.

Thus, by controlling switching of each transistor as above, +150 V appears only at output terminal 108-2 during the period from time t6 to t7 shown in FIG. 14 while −200 V appears at the other terminals. Accordingly, during this period, the driving circuit controls the control electrode by selectively applying +150 V only to the control electrode gate which is connected to output terminal 108-2 so that negatively charged toner will flow through this gate.

Figure 16:
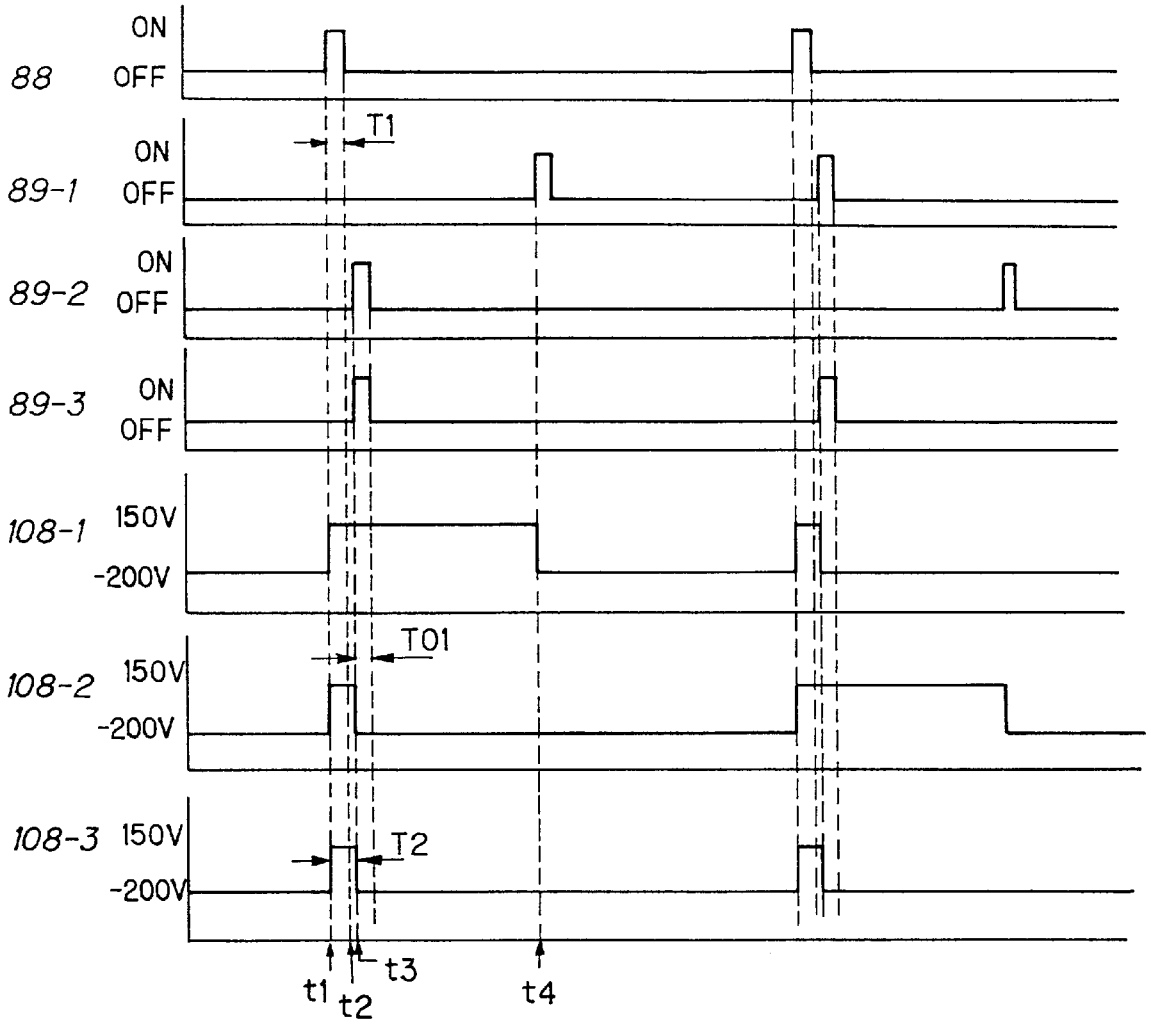
FIG. 16 is a timing chart for explaining another operating manner of the driving circuit in accordance with the first embodiment of the invention.

The switching control in each transistor shown in FIG. 13 may be performed following the timing chart shown in FIG. 16. In this case, at the initial state, transistors 88, and 89-1 to 89-3 are all turned off. From this initial state, first, only the transistor 88 is turned on for period T1 from time t1, so that all the output terminals have a potential of +150 V. Then, transistors 89-2 and 89-3 alone are turned on for period T01 from time t3. As a result, +150 V appears at only output terminal 89-1 from time t3 to t4, and this is selectively applied to the gate of the control electrode.

In accordance with this controlling method, since the transistors are turned on for only a certain period of time only when the level of the driving signal is switched and they are turned off during the other periods, the power consumption can be lowered compared to the controlling method shown in FIG. 14 above. Accordingly, it is possible to inhibit heat generation of elements, needing no cooling means.

In accordance with the controlling method shown in FIG. 16, however, since the level of the driving signal is maintained by the capacitance which parasitizes the output terminal, the level of the driving signal may vary because the charged electricity in the parasitic capacitance may dissipate due to leakage when control needs to be made so as to prohibit the toner from jumping for a long time as in such cases as pre-rotation and post-rotation, or during the paper feed interval for a new paper sheet.

In such a case, it is necessary to restore the output voltage by recharging or refreshing at intervals of a certain period even though no level change of the driving signal is needed. In this way, if there is a need to perform such control as to prohibit the toner from jumping for a long time, the controlling method shown in FIG. 14 is preferable. That is, in accordance with this method, since the voltage from low-voltage power source 85 (−200 V) is output via transistors 89-1 to 89-3, the potential of the driving signal can be maintained stably at this level.

Figure 17:
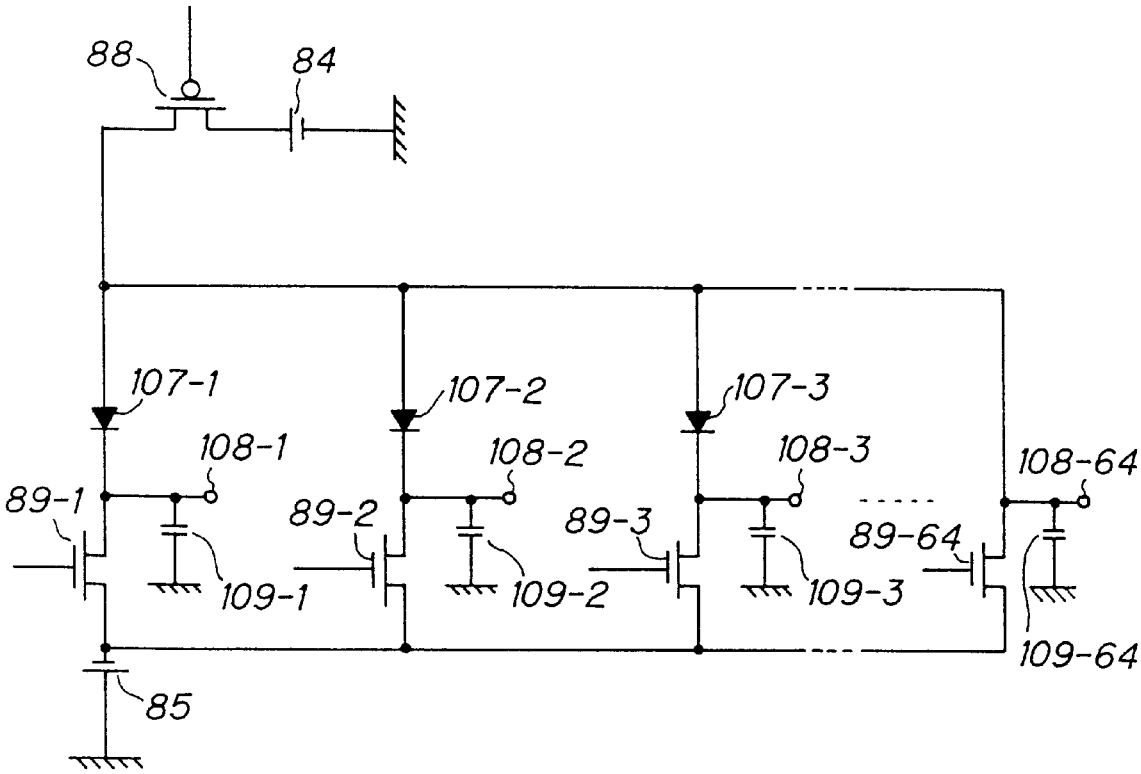
FIG. 17 is a circuit diagram showing a driving circuit in accordance with the first embodiment of the invention, wherein capacitance elements are provided on the output terminal side.

In the driving circuit of this embodiment, although the parasitic capacitance residing at the output terminal is utilized in order to maintain the high voltage after transistor 88 has been turned off, it is also possible to provide an actual capacitor 109-1 to 109-64 for each output terminal as shown in FIG. 17. This configuration enables more stable maintenance of the high voltage as the driving signal level.

Figure 18:
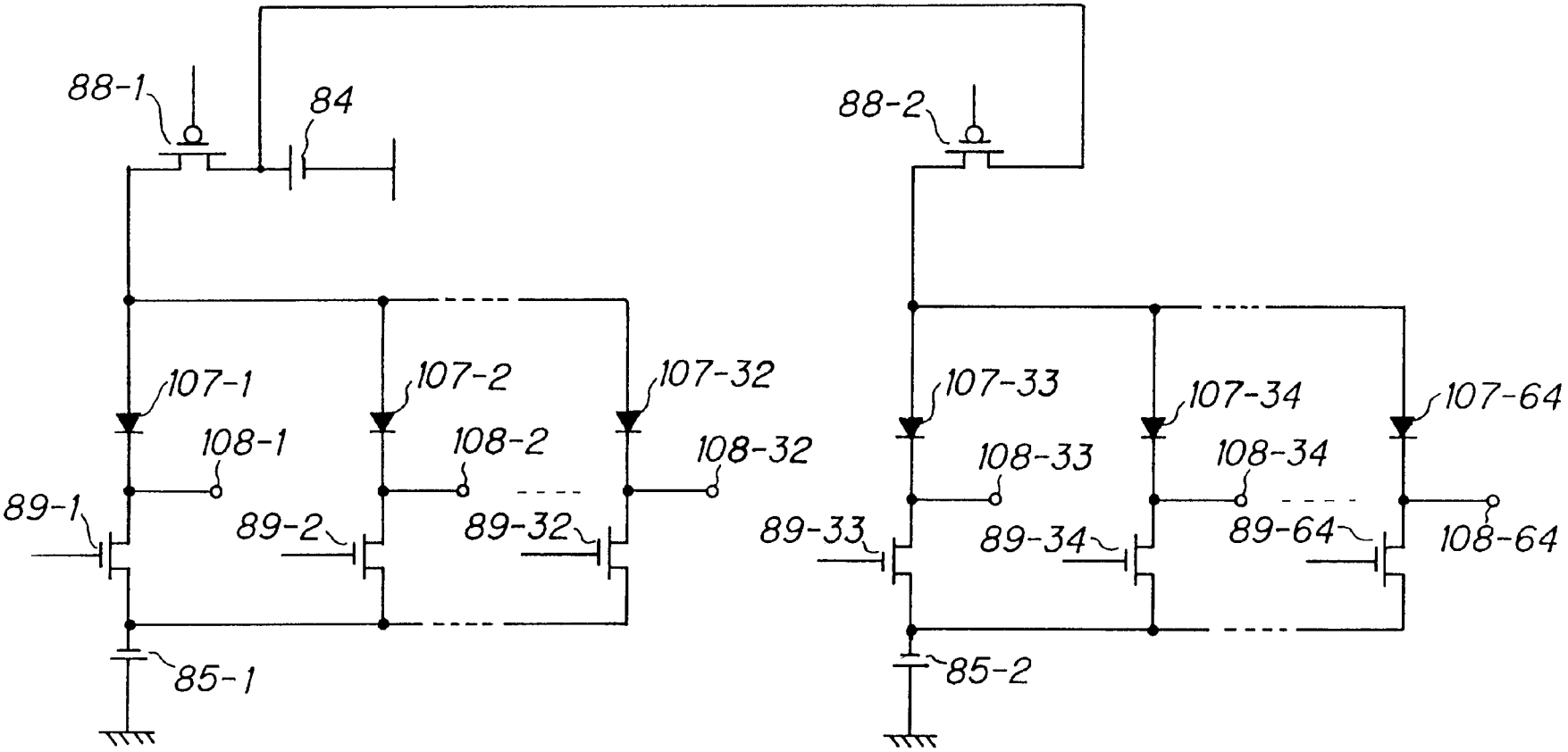
FIG. 18 is a circuit diagram showing a driving circuit of a variation of the first embodiment of the invention.

The configuration shown in FIG. 13 is constituted by a 64 channel output driver which includes a single p-type field effect transistor 88 with 64 n-type field effect transistors allotted for the outputs. It is also possible to configure a 64 channel driver by having two driver blocks of 32 channel outputs as shown in FIG. 18. More specifically, one 32-channel driving circuit is composed of a p-type transistor 88-1, diodes 107-1 to 107-32 and n-type transistors 89-1 to 89-32 while the other 32-channel driving circuit is composed of a p-type transistor 88-2, diodes 107-33 to 107-64 and n-type transistors 89-33 to 89-64.

In this configuration, separate low-voltage power sources 85-1 and 85-2 for supplying a low-voltage of −200 V are equipped for respective blocks, but these can be united as a single low-voltage power source. However, with a separate configuration, if two power sources are adapted to supply different low voltages from each other, it is possible to supply a suitable voltage to each gate in conformity with its distance to toner support 22. This configuration will be described hereinbelow.

Figure 19:
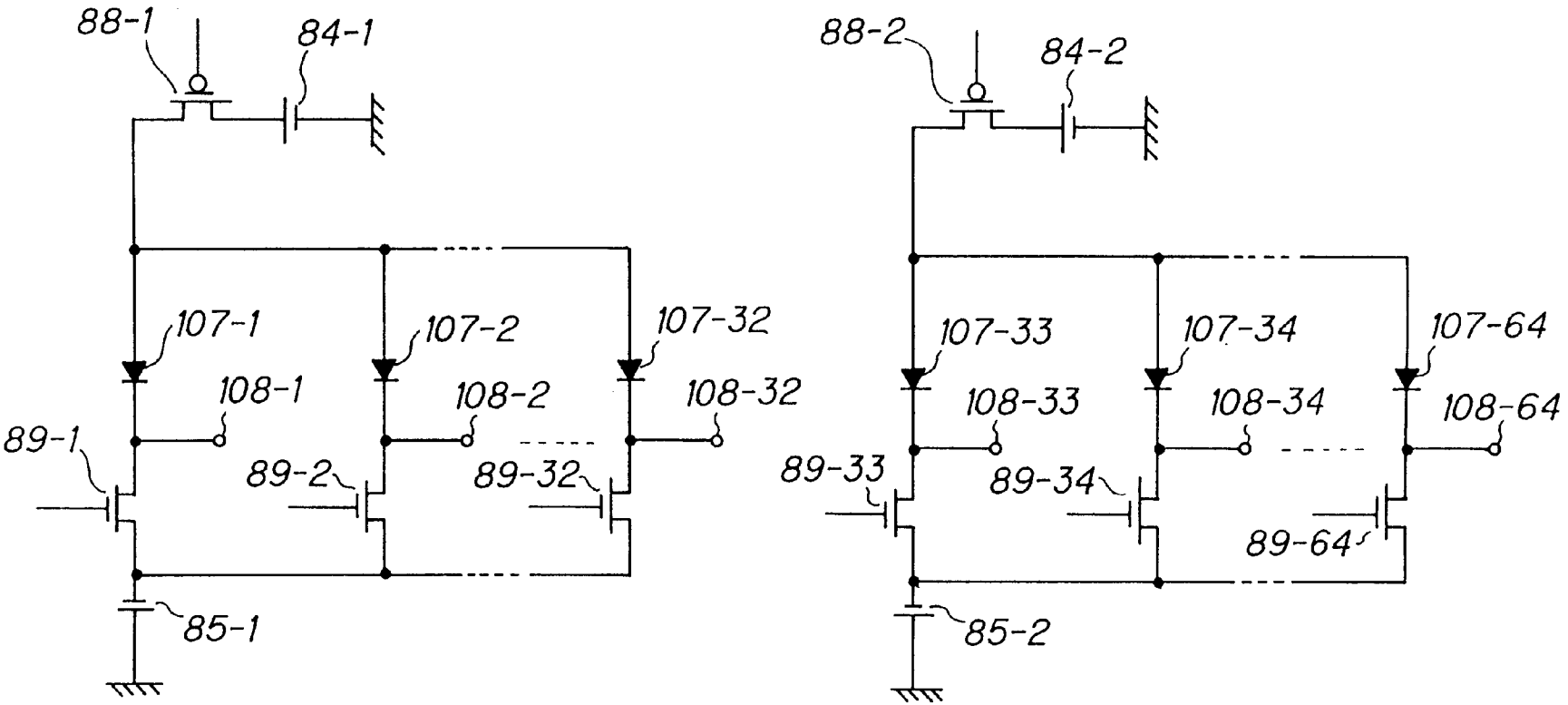
FIG. 19 is a circuit diagram showing a driving circuit of a variation of the first embodiment of the invention.

Further, as shown in FIG. 19, it is also possible to provide separate high-voltage power sources 84-1 and 84-2 for supplying +150 V to transistors 88-1 and 88-2, respectively. This configuration enables lowering of the current flowing through each of p-type transistors 88-1 and 88-2, thus lowering the heat generation of these transistors. Moreover, when low-voltage power sources 85-1 and 85-2 supply different voltages from each other, it is possible to supply a suitable voltage to each gate in conformity with its distance to toner support 22, as will be described hereinbelow.

(The second embodiment)

Figure 20:
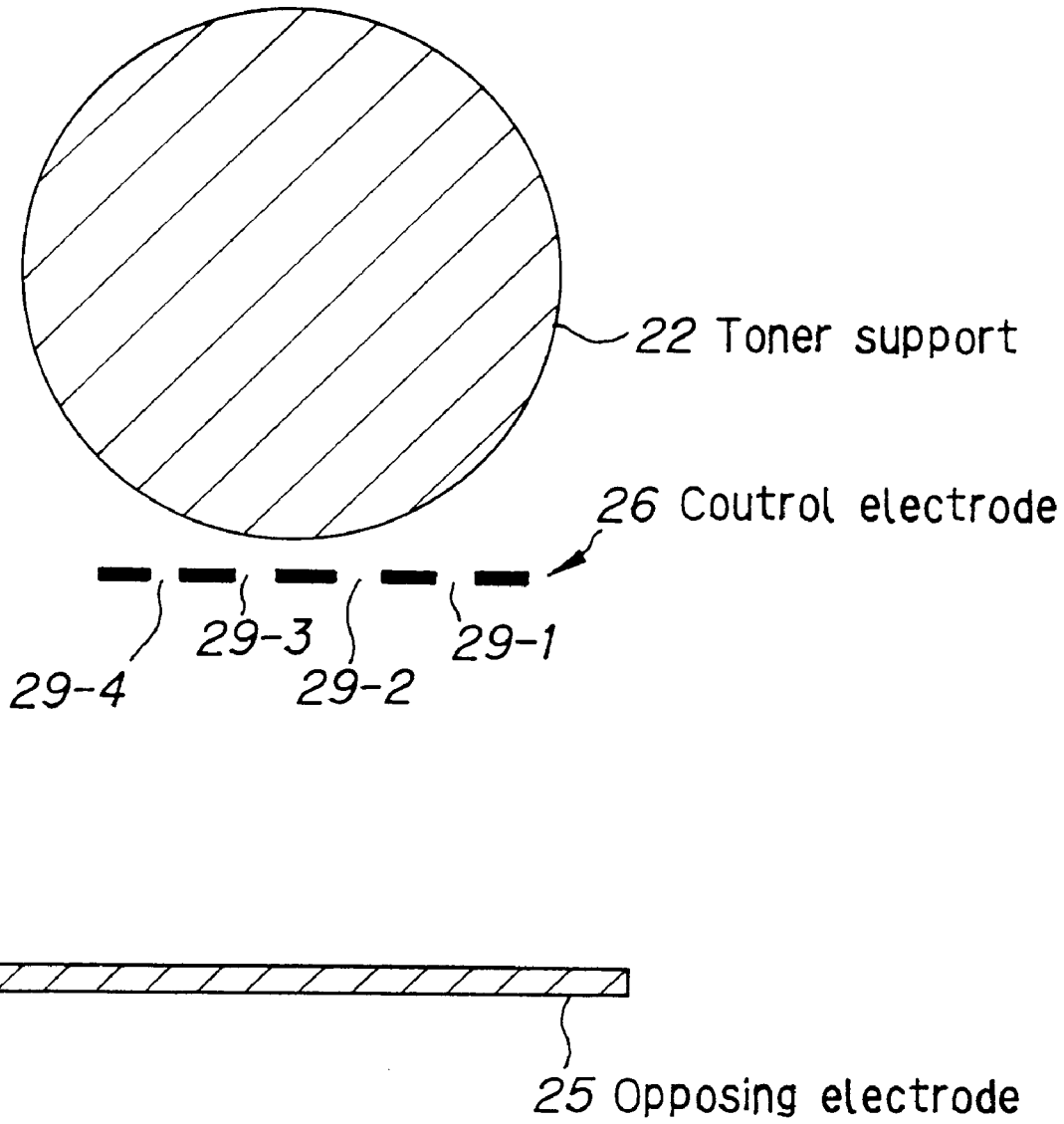
FIG. 20 is an illustrative view for explaining the presupposition for a driving circuit in accordance with the second embodiment of the invention.
Figure 21:
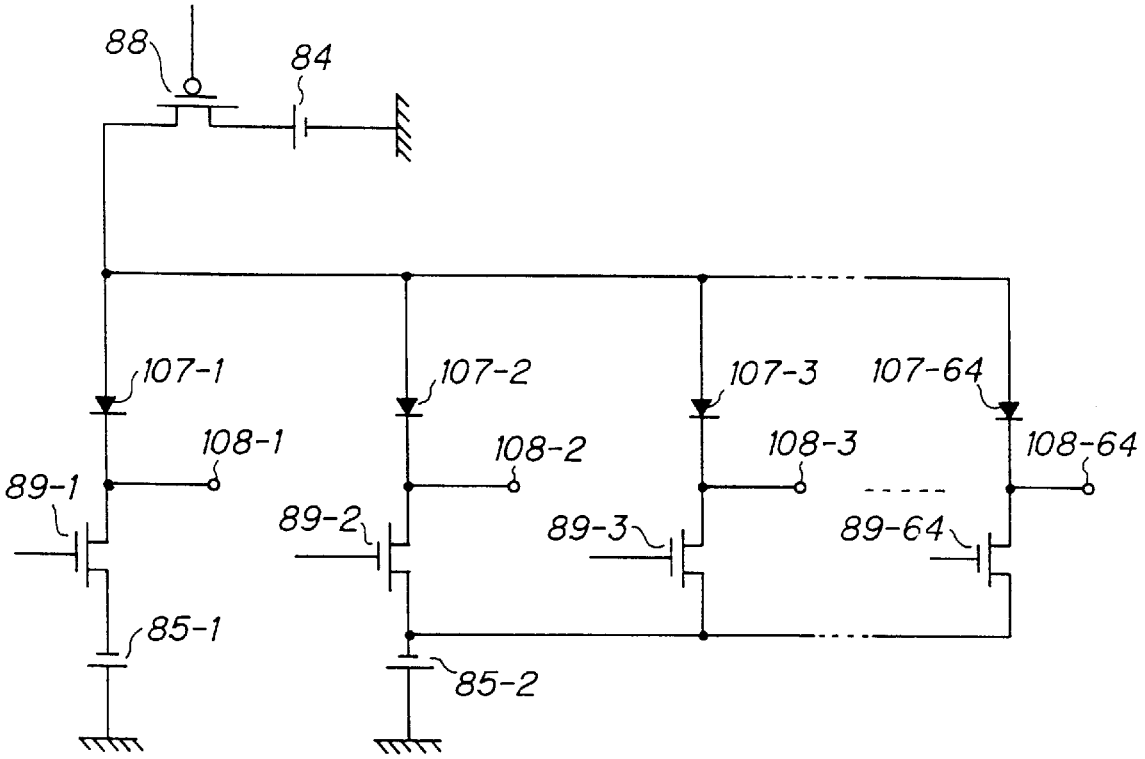
FIG. 21 is a circuit diagram showing a driving circuit in accordance with the second embodiment of the invention.

Referring next to FIGS. 20 and 21, a driving circuit in accordance with the second embodiment of the invention will be described.

The driving circuit of the first embodiment is adapted to supply either +150 V or −200 V as the driving signal levels to the gates of the control electrode. In this case, if, for example, 150 V which allows the toner to jump is applied to all gates, the resultant conditions of the electric field near the gates differ from one to another and hence the conditions of toner jumping also differ from one gate to another because the distance from one gate to toner support 22 differs from that from another gate to toner support 22.

More specifically, as schematically shown in FIG. 20, control electrode 26 has a planer configuration while toner support 22 has a curved peripheral surface. Therefore, in the same figure, gates 29-1 and 29-2 formed on control electrode 26 are not equidistant from the peripheral surface of toner support 22, so that if the same voltage is applied to the both, the condition of the electric field near one gate differs from that near the other gate. Therefore, even if the same potential is supplied to all, the manner of jumping of the toner transferring from toner support 22 to opposing electrode 25 differs depending upon the position of the gate in question.

In this embodiment, the voltage to be applied to a gate of the control electrode is adjusted in accordance with its distance to toner support 22, to thereby correct the difference in the manner of jumping toner dependent upon the gate position.

Illustratively, the driving circuit in accordance with this embodiment is configured as shown in FIG. 21. That is, in the driving circuit configuration in accordance with the first embodiment shown in FIG. 13, a low-voltage power source 85-1 is connected to the source of transistor 89-1, for example, while a low-voltage power source 85-2 is connected to the source of other transistors 89-2 to 89-64. Here, the voltage supplied from power source 85-2 is set even lower than that of power source 85-1.

In this configuration, when for example, output terminal 108-1 is connected to gate 29-1 shown in FIG. 20 and output terminal 108-2 is connected to gate 29-2, gate 29-2 which is closer to toner support 22 will have a lower voltage applied than gate 29-1. Therefore, the condition of the electric field near a gate can be controlled depending on the distance from toner support 22 so that it can be equal to the conditions of the electric field near other gates. Thus, it is possible to make the jumping state (in this case, the state of prohibiting the toner from jumping) of toner identical for all the gates.

Similarly, in the configuration shown in FIG. 19, the state of the electric field for making the toner jump can be made congruent by appropriately selecting a voltage from power source 84-1 or power source 84-2, and the state of the electric field for prohibiting the toner from jumping can be made congruent by appropriately selecting a voltage from power source 85-1 or power source 85-2 shown in FIGS. 18 and 19. Thus, it becomes possible to eliminate image density unevenness or ununiformity in dot size due to the positional relationship of the gates.

Further, for example, in the configuration of the first embodiment shown in FIG. 13, if transistor 88 and any one of transistors 89-1 to 89-64 were turned on simultaneously by noise or other reason, high-voltage power source 84 and low-voltage power source 85 form a short-circuit, and consequently, the devices constituting these power sources and the driving circuit could break down. To avoid this, a protection circuit such as a resistor element may be interposed between transistor 88 and each of transistors 89-1 to 89-64. For the configuration of the second embodiment, a similar protection circuit may be provided.

In the first embodiment, even when the toner is inhibited from jumping, transistor 88 is once turned on so that all the output terminals produce +150 V temporarily and then the gates are selectively set into −200 V. Hence, this configuration repeats a cycle of frequent charging and discharging at the output terminals, consuming electric energy proportionally.

To avoid this, it is possible to provide a separate judging circuit which distinguishes the state where all the gates are set to the voltage for prohibiting the toner from jumping and then control the system based on this judgment from the judging circuit so that all transistors, 88 and 89-1 to 89-64, are switched off by force. This configuration can cut out the unnecessary operation of the transistors, and hence the waste consumption of power can be eliminated. This control can also be applied to the second embodiment.

Further, in the first embodiment, if increase in energy consumption is allowed, transistor 88 may be turned on continuously. In this case, transistor 88 functions as a kind of pull-up resistance, and output terminals to output −200 V can be selected by selectively activating transistors 89-1 to 89-64 (unselected terminals will output +150 V). In this case, if transistor 88 is set up so that it will be fixedly turned on within its region of saturation, no excessive current over that required will flow, and hence the energy consumption can be efficiently suppressed. A similar configuration can be applied to the second embodiment.

Moreover, in the first embodiment, toner support 22 is grounded, but it is possible to configure such a system in which the sources of transistors 89-1 to 89-64 are grounded while toner support 22 is biased at −200 V and high-voltage power source 84 supplies a voltage of +350 V. In this case, low-voltage power source 85 can be left out, thus making it possible to further simplify the apparatus. Since the energy used for biasing toner support 22 is much lower than the power consumption for the on/off switching operation of the transistors in the above driving circuit, a power source having a very low current capability is sufficient enough to bias toner support 22 at −200 V.

(Concerning integration)

Next, a specific integrated circuit of the above embodiment will be described.

Figure 22:
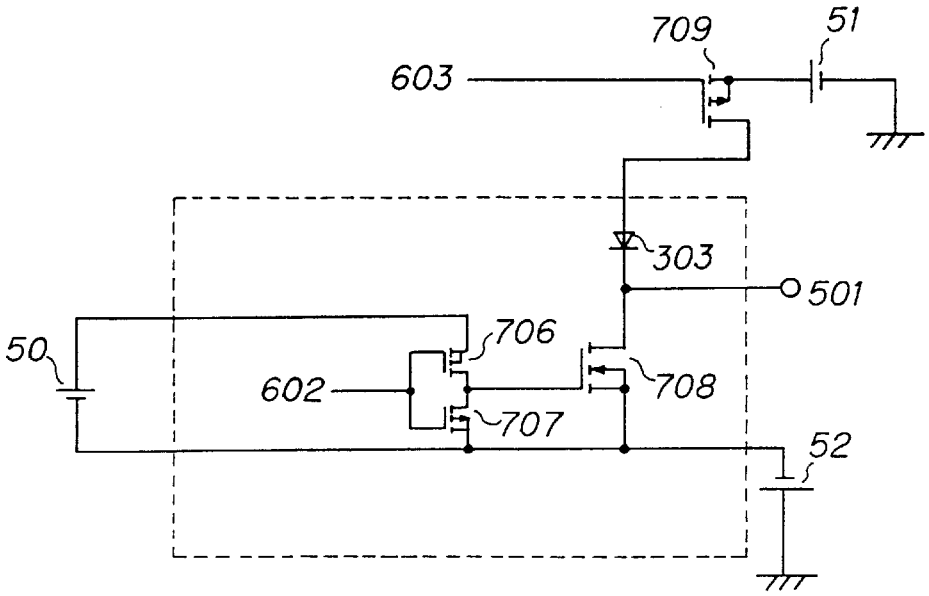
FIG. 22 shows a basic circuit to be integrated.

FIG. 22 shows a basic circuit (1 ch) for integration. This basic circuit is composed of a p-channel MOS FET 709 with its source connected to high-voltage power source 51, a diode 303 with its anode connected to the drain of p-channel MOS FET 709 and a n-channel MOS FET 708 with its drain connected to the cathode of diode 303 and its source connected to low-voltage power source 52. In this configuration, the drain of n-channel MOS FET 708 is connected to an output terminal 501. Further, a p-channel MOS FET 706 and an n-channel MOS FET 707 are connected to each other at their drain with their sources connected to logic power source 50. The output from these drains is connected to the gate of n-channel MOS FET 708. The operation of this circuitry has been described in the above first embodiment, so is omitted here.

Figure 9:
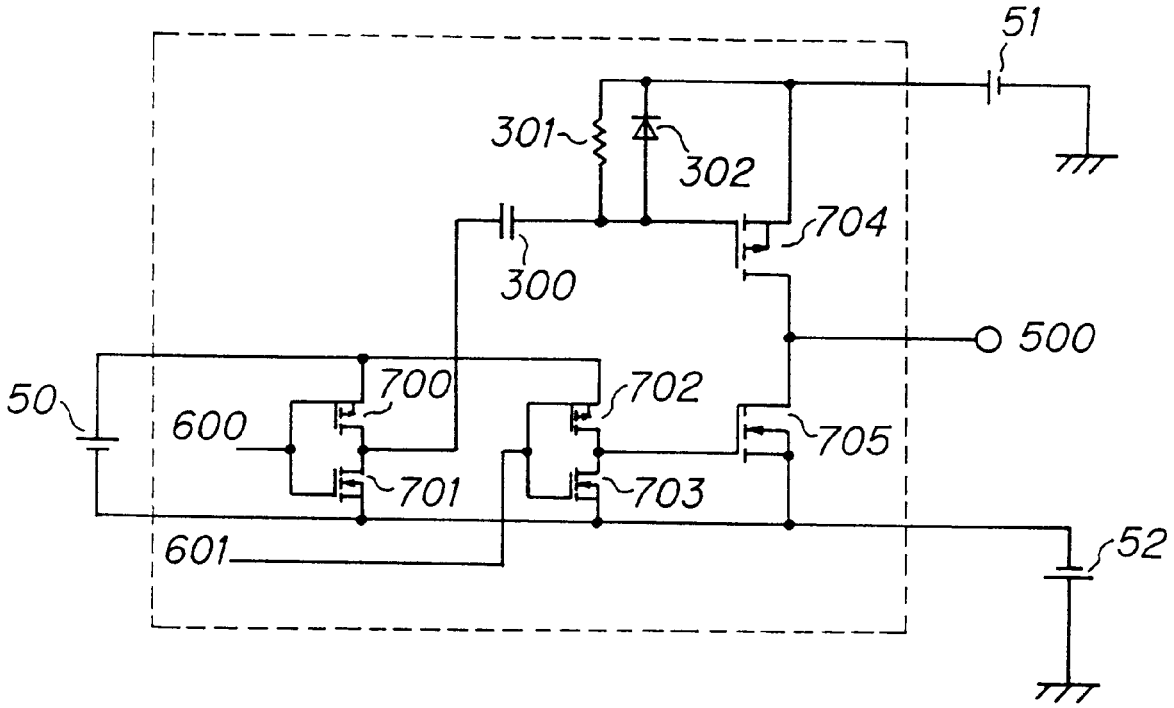
FIG. 9 PRIOR ART
FIG. 9 is a circuit diagram showing an IC having a typical complimentary configuration.
Figure 10:
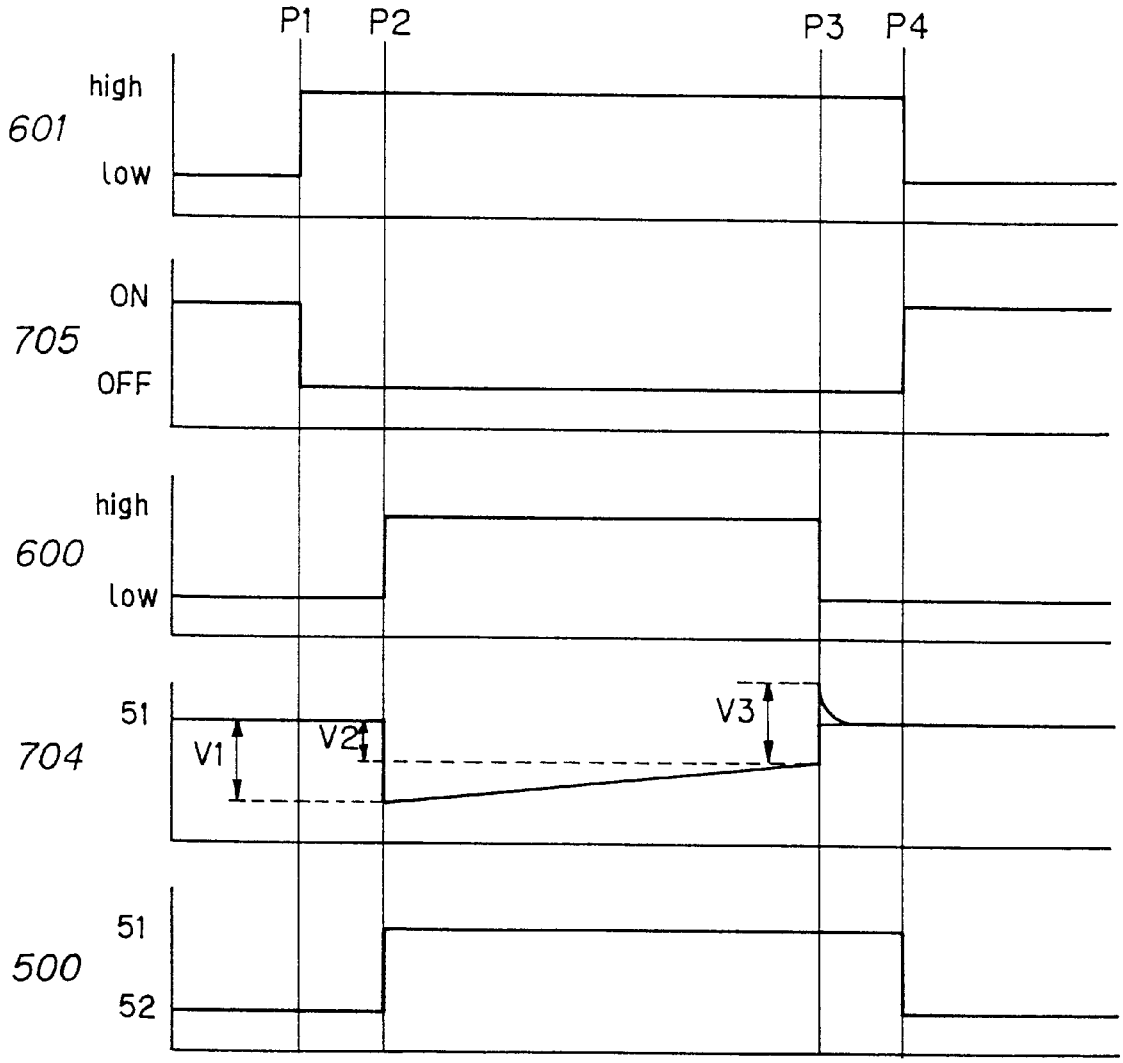
FIG. 10 PRIOR ART
FIG. 10 is a timing chart for this IC circuit.

As compared in the prior art shown in FIG. 9, the basic circuit of FIG. 22 does neither need resistor 301, Zener diode 302 as the circuit components of a level shifter or buffer transistors 700/701 to which the driving control signal 600 is input. Further, capacitor 300 which is most problematic to integrate is no longer needed. In this way, this configuration can markedly cut down the number of parts and hence can reduce the IC chip area.

Figure 23:
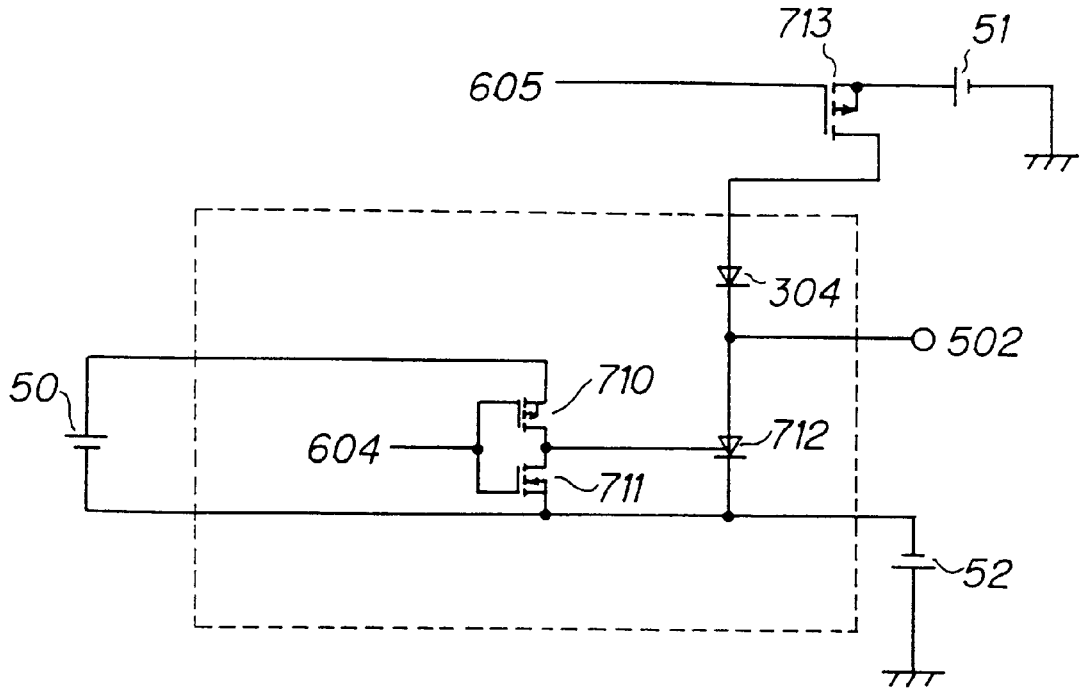
FIG. 23 is a block diagram showing another basic circuit to be integrated.
Figure 24:
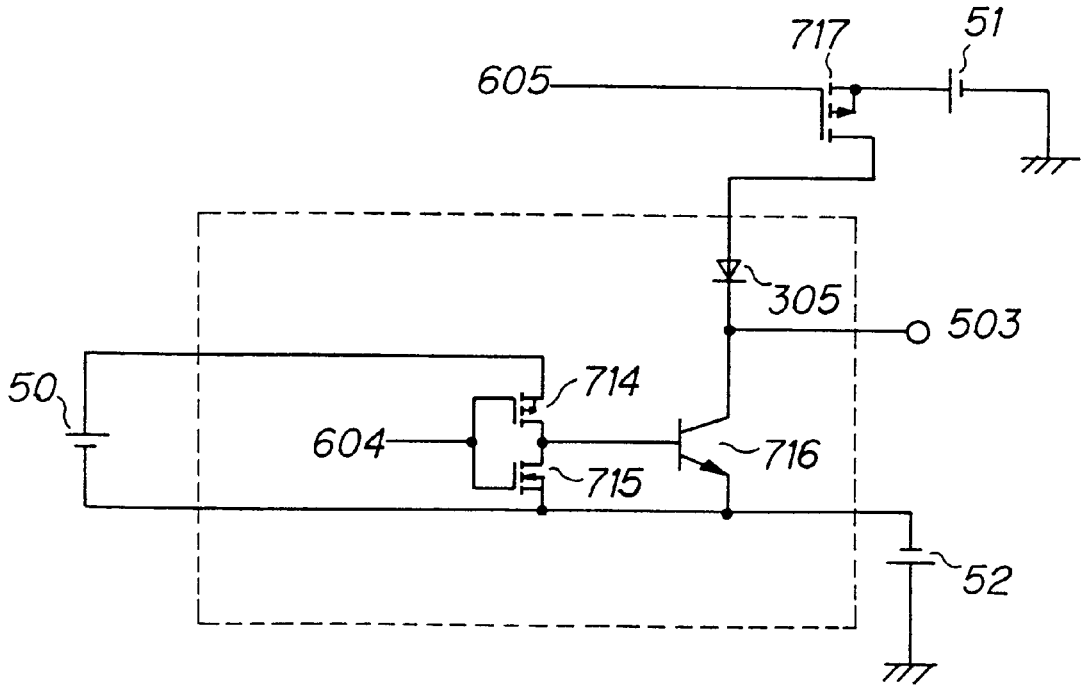
FIG. 24 is a block diagram showing still another basic circuit to be integrated.
Figure 25:
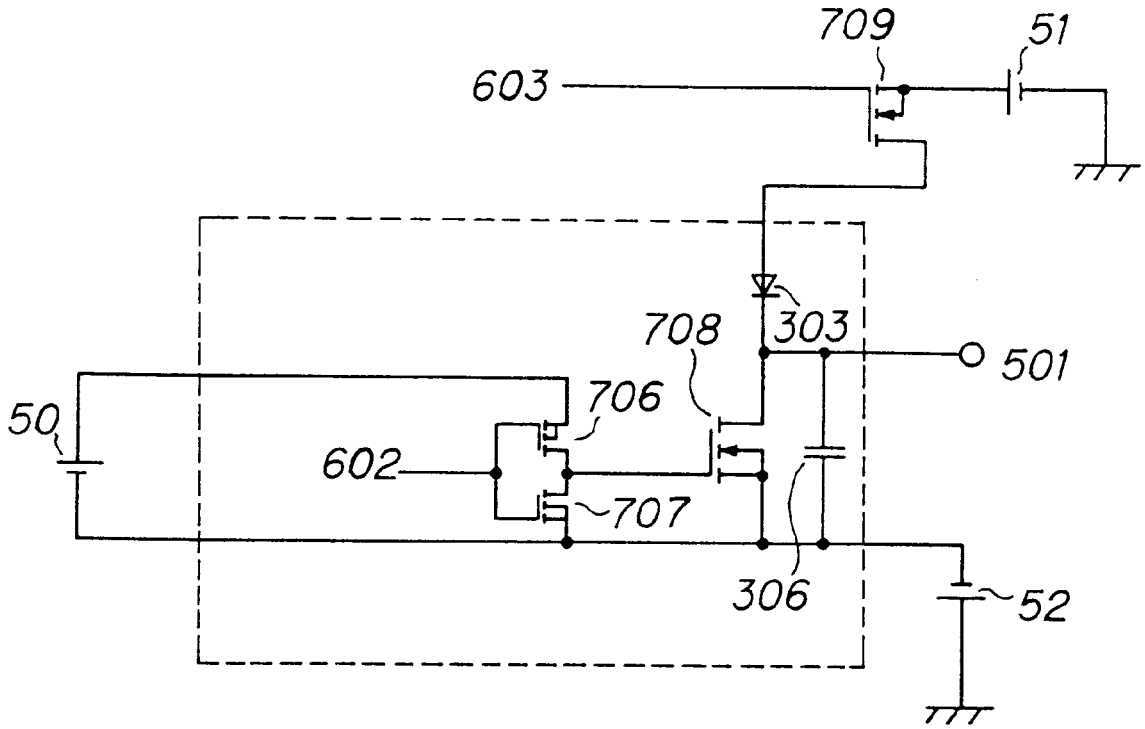
FIG. 25 is a block diagram showing a still further basic circuit to be integrated.

The basic circuit of FIG. 22 uses field effect transistors, but a thyristor 721 as shown in FIG. 23 or a transistor 716 as shown in FIG. 24 may be used in place of n-channel MOS FET 708. It is also possible to provide a capacitor 306 connected between the output terminal and low-voltage power source 52 in a similar manner as in FIG. 17 in order to stably maintain the high voltage as the driving signal level (cf. FIG. 25). Here, the voltages of power sources 50, 51 and 52 are not particularly specified.

Figure 26:
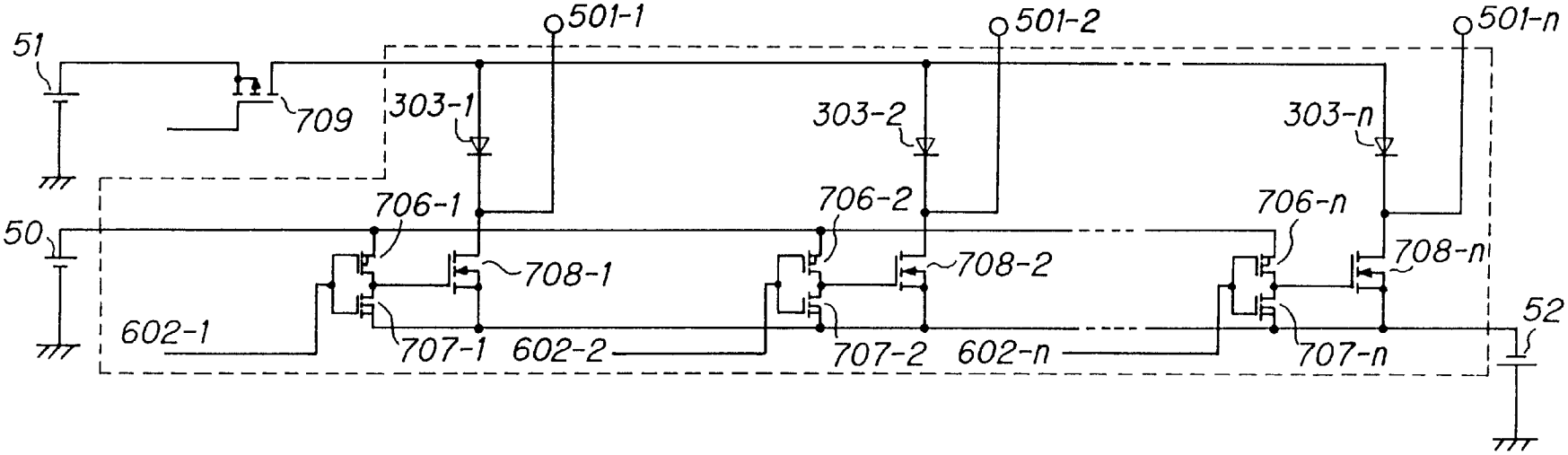
FIG. 26 is a block diagram showing an integration example of an IC having n channel outputs using the basic circuits shown in FIG. 22.

FIG. 26 is an example of an IC in which n number of the basic circuits in FIG. 22 are integrated forming n channel outputs. In this example, p-channel MOS FET 709 is set outside.

When integrated, the integrated circuit has n number (equal to the number of channels) of transistors 708 (namely 708-1 to 708-n) for controlling outputs, with n pairs of complementary transistors 706/707 for controlling transistors 708 that control these outputs.

Figure 11:
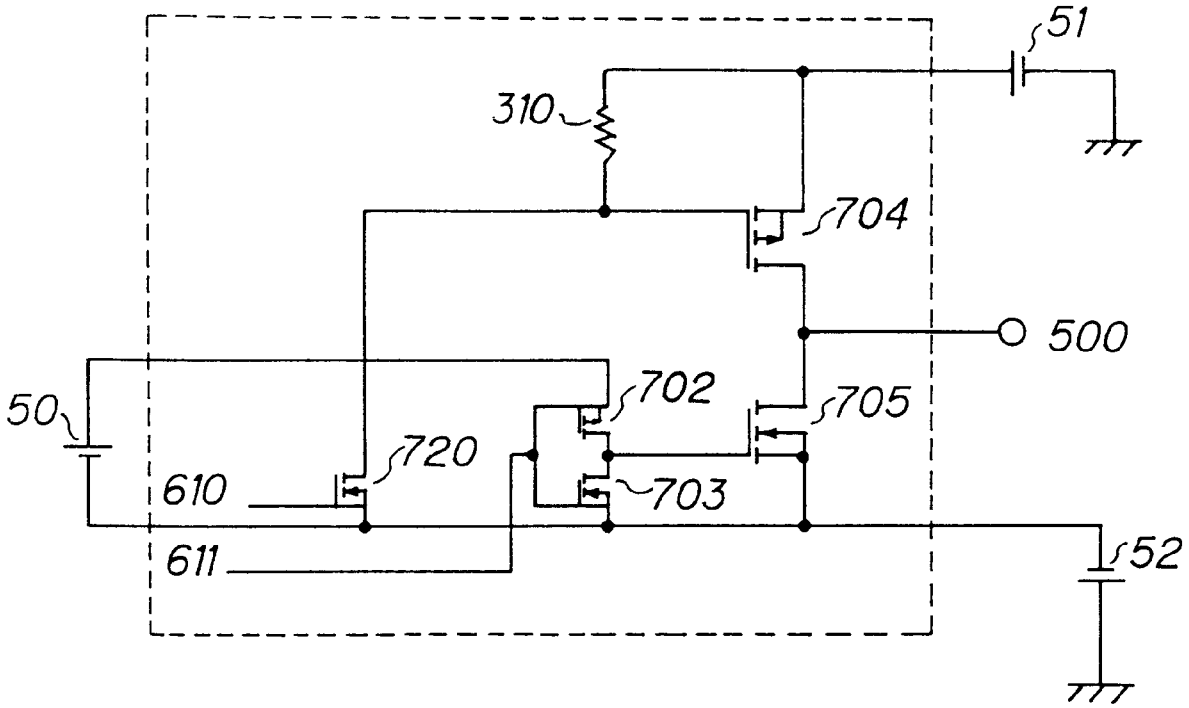
FIG. 11 PRIOR ART
FIG. 11 is a circuit diagram showing an IC circuit using a pull-up method.
Figure 12:
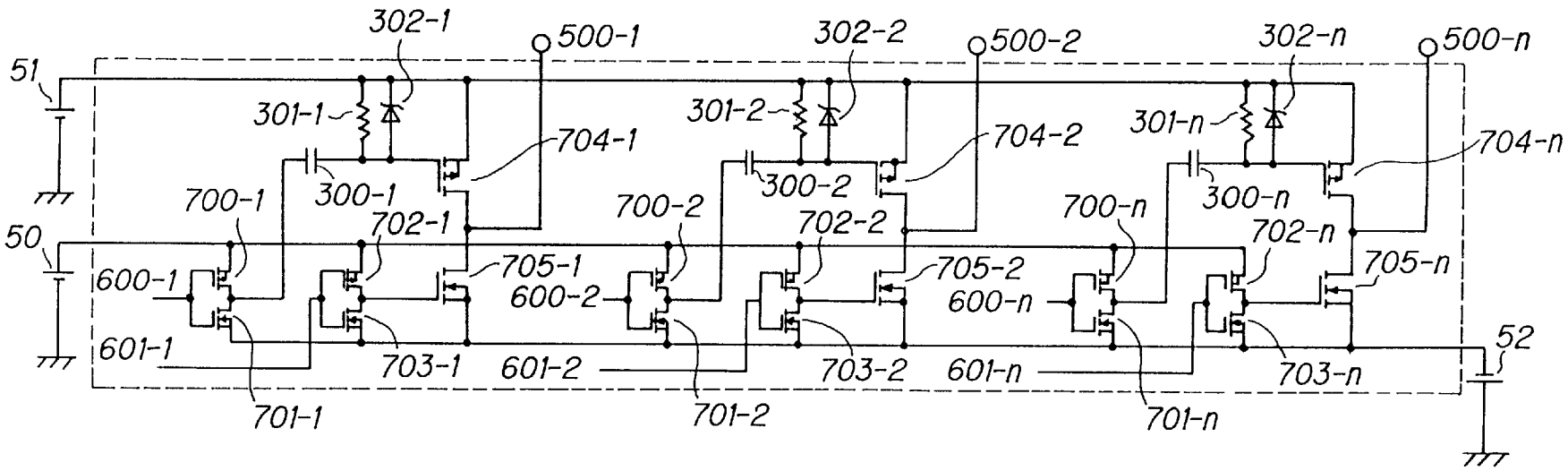
FIG. 12 PRIOR ART
FIG. 12 is a circuit diagram showing a conventional integration example having n outputs.

When compared to the conventional IC configuration in FIG. 11, it is understood that transistors and other parts are markedly reduced in number. In this example, p-channel MOS FET 709 is not the target to be integrated. This is because, when a plurality of ICs of this type (e.g. 20 of the ICs) are used, only one p-channel FET 709 is needed and it is also becomes unnecessary to integrate the level shifter capacitor etc. for driving transistor 709. Therefore, it is possible to avoid waste of the IC area, and hence reduce the size of the IC. For example, when a 64 ch integrated circuit is considered, 64 output transistors (704), 128 control transistors (700/701), 64 level shifter circuit resistors (301) and 64 capacitors (300) can be left out.

In an IC having a multiple number of outputs, the current flowing through p-channel MOS FET 709 becomes large and hence generates much heat. Therefore, the provision of this FET outside the integration contributes to avoiding heat generation in the chip and reduction in size of the package.

Figure 27:
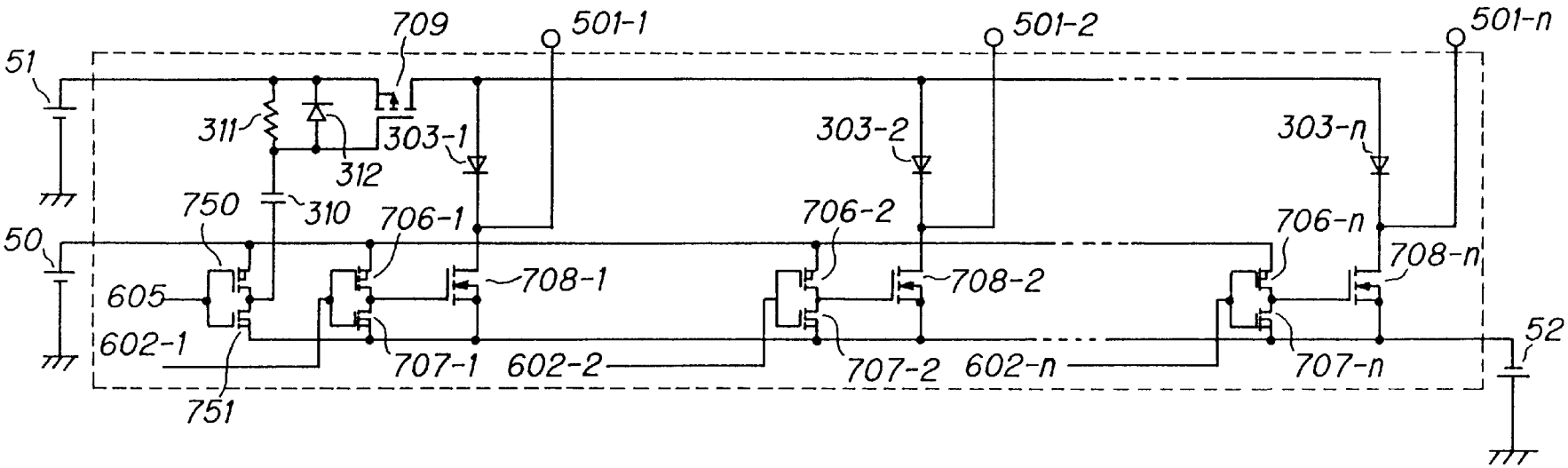
FIG. 27 is a block diagram showing another integration example of an IC.

FIG. 27 is a circuit configuration in which p-channel MOS FET 709 is integrated. In this circuit, the anodes of a plurality of diodes 303-1 to 303-n are commonly connected to the drain of p-channel MOS FET 709. As the driving circuit, a pair of p-channel MOS FET 750 and n-channel MOS FET 751 are provided with their drains connected to each other. The drain of this driving circuit is connected to p-channel MOS FET 709 via a capacitor 310. A parallel circuit of a resistor 311 and diode 312 is connected between the source and gate of p-channel MOS FET 709.

This configuration enables one-chip control as long as the current flowing through p-channel MOS FET 709 falls within the allowable range for the package, and hence is quite advantageous in reducing the size and in the aspect of cost because there are no external parts.

Figure 28:
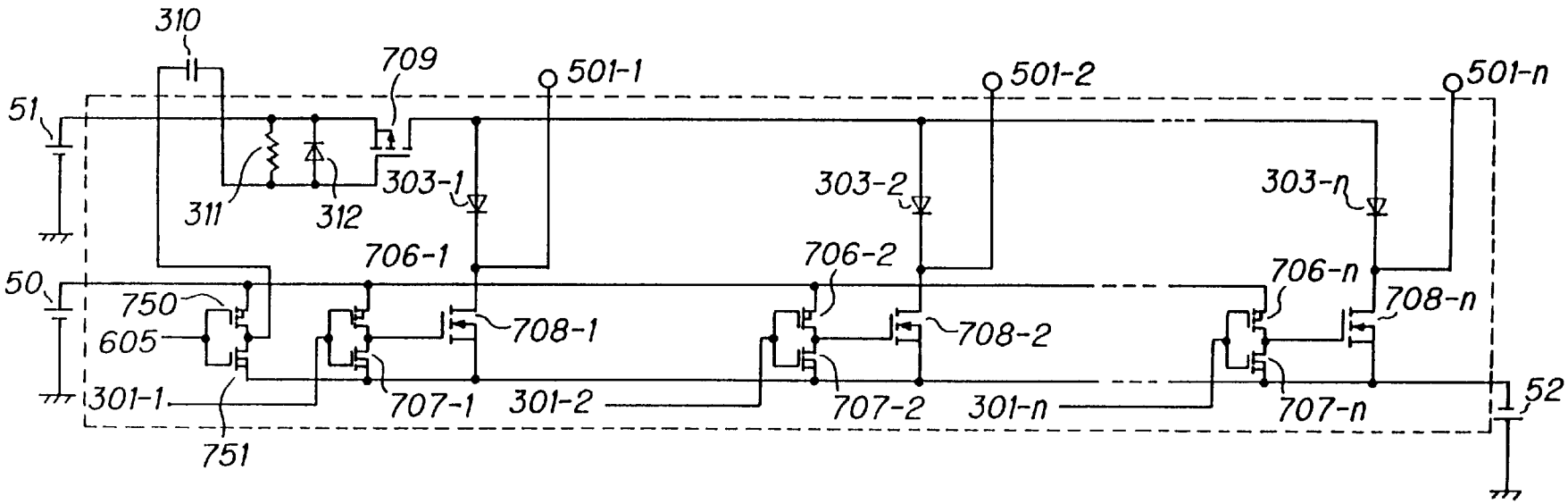
FIG. 28 is a block diagram showing a further integration example of an IC.

FIG. 28 is a similar circuit to that of FIG. 27, except in that only capacitor 310 which needs a large IC chip area is set outside the integration. This configuration also reduces the number of parts and further decreases the size.

As apparent from the above description, the following advantages can be attained by the invention.

In accordance with the first and seventh to fourteenth configurations of the invention, the voltage from a high-voltage power source is once supplied to all the output terminals by means of the first semiconductor switch, and then a plurality of the second semiconductor switches are selectively turned on so as to selectively output the voltage from the low-voltage power source. Therefore, it is possible to reduce the number of first semiconductor switches for feeding the voltage from the high-voltage power source.

Accordingly, when a p-type field effect transistor is used as the first semiconductor switch, it is possible to definitely reduce the number of p-type field effect transistors which are large in size as compared to n-type field effect transistors. Therefore, this configuration efficiently reduces the chip area when it is provided as an LSI, and hence makes it possible to make the apparatus more compact and inexpensive. Further, this configuration is effective in suppressing waveform distortion as compared to a driving circuit using pull-up resistance, and still can provide output signals (driving signals) as good as those of a push-pull type circuit configuration.

In accordance with the second and seventh to fourteenth configurations of the invention, since a plurality of the first semiconductor switches for feeding the voltage from the high-voltage source are provided, it is possible to reduce the current flowing through each of the first semiconductor switches, thus making it possible to effectively suppress the heat generation from the element. As a result, no cooling means is needed in order to maintain those of the transistor's characteristics which have dependence upon temperature, and hence the cost for the cooler can be eliminated.

In accordance with the third, fifth and seventh to fourteenth configurations of the invention, since a plurality of the second semiconductor switches are connected to one of plural low-voltage power sources, it is possible to make the application of a low voltage to the control electrode by selecting one from the plurality of low-voltage power sources. Accordingly, it is possible to supply a suitable low voltage to each gate of the control electrode in conformity with its position. Thus, this configuration makes the state of toner jumping congruent, enabling formation of high-quality images. Also, since it is also possible to reduce the power capacity of each low-voltage power source, it is possible to cut down the total cost of the power sources.

In accordance with the fourth, sixth and seventh to fourteenth configurations of the invention, since a plurality of the first semiconductor switches are connected to one of plural high-voltage power sources, it is possible to make application of a high voltage to the control electrode by selecting one from the plurality of high-voltage power sources. Accordingly, it is possible to supply a suitable low voltage to each gate of the control electrode in conformity with its position. Thus, this configuration makes the state of toner jumping congruent, enabling formation of high-quality images. Besides, since it is also possible to reduce the power capacity of each high-voltage power source, it is possible to cut down the total cost of the power sources.

In accordance with the seventh feature of the invention, since a capacitance element is provided on the drain side (output terminal side) of the second semiconductor switch, the potential level of the driving signal at the output terminal can be stably maintained without being affected by environmental variations, after the first and second semiconductor switches have been turned off, so that it is possible to stabilize the control of the control electrode.

In accordance with features of the first to eleventh features of the invention, the level shifter circuit components and buffer transistors which were needed in the conventional art are not needed, thus it is possible to markedly reduce the number of parts and hence reducing the chip area of the IC when it is integrated. In particular, in the case of an IC having a plurality of outputs, this configuration is advantageous very much.

In accordance with the twelfth feature of the invention, since in an IC having a large number of outputs, the current flowing through the first semiconductor switch is large and generates a great amount of heat, this switch is provided outside the integration, thus preventing the heat generation of the chip as well as easily making the package compact.

In accordance with the thirteenth feature of the invention, when the current flowing through the first semiconductor switch is within the range allowed by the package, one-chip control can be performed which needs few external parts and makes it possible to make the device compact.

In accordance with the fourteenth feature of the invention, since the capacitance for the level shifter which needs a large integration (IC) area is set outside the integration, it is possible to minimize the chip area of the IC.

What is claimed is:

1. A driving circuit for driving a control electrode having a plurality of control sections in an image forming apparatus which creates an image by making selected substantially identically electrostatically charged toner particles contained in a substantially continuous layer thereof carried by a toner support jump from the toner support to an electrostatically charged recording medium by electric force; said driving circuit comprising:

a first semiconductor switch, said first semiconductor switch having the capability of alternately assuming an on state and an off state, and including a drain and a source, said source being adapted to be connected to a high-voltage power supply;

a plurality of diodes, each said diode comprising an anode and a cathode, said anodes of said plurality of diodes being connected in common to said drain of said first semiconductor switch; and a plurality of second semiconductor switches, each of said second semiconductor switches having the capability of alternately assuming an on state and an off state, and including (a) a drain connected (i) to a cathode of a corresponding one of said plurality of diodes and (ii) to an output terminal adapted to be connected to a corresponding one of said control sections of said control electrode, and (b) a source connected in common with the sources of the other second semiconductor switches to a low-voltage power supply;

said driving circuit being further characterized in that:

said first semiconductor switch is normally in said off state and is adapted to be caused to assume its on state at a selected point in time defining a reference point for driving said control electrode, and subsequently to be caused to reassume its normal off state after a first predetermined period of time;

selected ones of said plurality of second semiconductor switches each are normally in their respective on states, and are adapted to be caused to assume their respective off states at said selected point in time and thereafter to be caused to reassume their respective on states after a second predetermined period of time; and the remainder of said plurality of second semiconductor switches each are normally in their respective on states, and are adapted to be caused to assume their respective off states at said selected point in time and thereafter to be caused to reassume their respective on states after a third predetermined period of time;

said second predetermined period of time being longer than said first predetermined period of time, and shorter than said third predetermined period of time;

whereby a voltage substantially equal to that supplied by said high-voltage power supply or a voltage substantially equal to that supplied by said low-voltage power supply always appears on the respective drains of each of said plurality of second semiconductor switches for output via said output terminal to a corresponding section of said control electrode during the operation of said driving circuit.

2. The driving circuit for driving a control electrode in an image forming apparatus according to claim 1, wherein a capacitance element is connected to said drain of each of said plurality of second semiconductor switches.

3. The driving circuit for driving a control electrode in an image forming apparatus according to claim 1, wherein said first predetermined period of time is longer than the time required for the output of each of said plurality of second semiconductor switches to equal the voltage of said high-voltage power source, and said second predetermined period of time is shorter than the time period measured from when said voltage of said high-voltage power supply is first applied to said output terminals until said selected particles of said toner jump from said toner support to said electrastatically charged recording medium.

4. The driving circuit for driving a control electrode in an image forming apparatus according to claim 1, wherein said first and said second semiconductor switches are p-type and n-type field effect transistors, respectively.

5. The driving circuit for driving a control electrode in an image forming apparatus according to claim 1, wherein said first semiconductor switch is a p-type field effect transistor and said second semiconductor switches are n-p-n type transistors.

6. The driving circuit for driving a control electrode in an image forming apparatus according to claim 1, wherein said first semiconductor switch is a p-type field effect transistor and said second semiconductor switches are thyristors.

7. The driving circuit for driving a control electrode in an image forming apparatus according to claim 1, wherein;

1) said plurality of diodes and said plurality of second semiconductor switches are located in at least one integration; and, (2) said first semiconductor switch connected in common to the anode of each of said plurality of diodes is set outside said at least one integration.

8. The driving circuit for driving a control electrode in an image forming apparatus according to claim 1, further comprising a second driving circuit for driving said first semiconductor switch, and wherein all of the elements of said driving circuit are located inside a single integration.

9. The driving circuit for driving a control electrode in an image forming apparatus according to claim 1, further comprising a second driving circuit connected via a capacitor to said first semiconductor switch wherein all of the elements of said driving circuit except said capacitor are set in a single integration.

10. A driving circuit for driving a control electrode having a plurality of control sections in an image forming apparatus which creates an image by making selected toner particles contained in a substantially continuous layer of substantially identically electrostatically charged toner particles carried by a toner support jump from the toner support to an electrostatically charged recording medium by electric force; said driving circuit comprising:

a plurality of first semiconductor switches, each said switch having the capability of alternately assuming an on state and an off state, being normally in said off state, and including a drain and a source , said source adapted to be connected to a high-voltage power supply;

a plurality of diodes, each said diode comprising an anode and a cathode, and the anode of each said diode being connected to a corresponding drain of one of said plurality of first semiconductor switches; and a plurality of second semiconductor switches, each of said second semiconductor switches having the capability of alternately assuming an on state and an off state, and including (a) a drain connected (i) to a cathode of a corresponding one of said plurality of diodes, and (ii) to a corresponding output terminal adapted to be connected to a corresponding one of said control sections of said control electrode, and (b) a source connected in common with the sources of the other second semiconductor switches to a low-voltage power supply;

said driving circuit being further characterized in that:

said first semiconductor switches are normally in their respective off states, and are adapted to be caused to assume their respective on states at a selected point in time defining a reference point for driving said control electrode, and subsequently to be caused to reassume their respective normal off states after a first predetermined period of time;

selected ones of said plurality of second semiconductor switches are adapted to be caused to assume their respective off states at said selected point in time and thereafter to be caused to reassume their respective on states after a second predetermined period of time; and the remainder of said plurality of second semiconductor switches are normally in their respective on states, are adapted to be caused to assume their respective off states at said selected point in time and thereafter to be caused to reassume their respective on states after a third predetermined period of time;

the second predetermined period of time being longer than the first predetermined period of time and shorter than the third predetermined period of time;

whereby a voltage appearing on the respective drains of each of said plurality of second semiconductor switches always is adapted to be output via a corresponding one of said output terminals to a corresponding one of said sections of said control electrode during the operation of said driving circuit.

11. A driving circuit for driving a control electrode including a plurality of control sections in an image forming apparatus which creates an image by making selected toner particles contained in a substantially continuous layer of substantially identically electrostatically charged toner particles carried by a toner support jump from the toner support to an electrostatically charged recording medium by electric force; said driving circuit comprising:

a first semiconductor switch, said first semiconductor switch having the capability of alternately assuming an on state and an off state, and including a drain and a source, said source being adapted to be connected to a high-voltage power supply;

a plurality of diodes, each said diode comprising an anode and a cathode, and the anode of each said diode being connected to said drain of said first semiconductor switch; and a plurality of second semiconductor switches, each of said second semiconductor switches having the capability of alternately assuming an on state and an off state, including (a) a drain connected (i)to a cathode of a corresponding one of said plurality of diodes and (ii) to an output adapted to be connected to a corresponding one of said control sections of said control electrode, and (b) a source adapted to be connected to one of a plurality low-voltage power supplies;

said driving circuit being further characterized in that:

said first semiconductor switch is normally in its off state, is adapted to be caused to assume its on state at a selected point in time defining a reference point for driving said control electrode, and thereafter to be caused to reassume its off state after a first predetermined period of time;

selected ones of said plurality of second semiconductor switches are normally in their respective on states, and are adapted to be caused to assume their respective off states at said selected point in time and thereafter to be caused to reassume their respective on states after a second predetermined period of time; and the remainder of said plurality of second semiconductor switches are normally in their respective on states, and are adapted to be caused to assume their respective off states at said selected point in time and thereafter to reassume their respective on states after a third predetermined period of time;

said second predetermined period of time being longer than said first predetermined period of time and shorter than said third predetermined period of time;

whereby the voltage appearing on the respective drains of each of said plurality of second semiconductor switches is always output via a corresponding one of said output terminals to a corresponding respective one of said sections of said control electrode during the operation of said driving circuit.

12. The driving circuit for driving a control electrode in an image forming apparatus according to claim 11, wherein each of said plurality of low-voltage power supplies provides a different voltage.

13. A driving circuit for driving a control electrode having a plurality of control sections in an image forming apparatus which creates an image by making selected toner particles contained in a substantially continuous layer of substantially identically electrostatically charged toner particles carried by a toner support jump from the toner support to an electrostatically charged recording medium by electric force; said driving circuit comprising:

a plurality of first semiconductor switches, each said switch having the capability of alternately assuming an on state and an off state, and including a drain and a source, said source being adapted to be connected to one of at least one high-voltage power supply;

a plurality of diodes, each said diode comprising an anode and a cathode, and the anode of each said diode being connected to the drain of one of said plurality of first semiconductor switches; and a plurality of second semiconductor switches, each of said second semiconductor switches having the capability of alternately assuming an on state and an off state, and including (a) a drain connected (i) to a cathode of a corresponding one of said plurality of diodes and (ii) to an output adapted to be connected to a corresponding one of said control sections of said control electrode, and (b) a source connected to one of at least one low-voltage power supply;

said driving circuit being further characterized in that:

said first semiconductor switches are normally in their respective of states, and adapted to be caused to assume their respective on states at a selected point in time defining a reference point for driving said control electrode, and thereafter to be caused to reassume their respective off states after a first predetermined period of time;

selected ones of said plurality of second semiconductor switches being adapted to be caused to assume their respective off states at said selected point in time and thereafter to be caused to reassume their respective on states after a second predetermined period of time; and the remainder of said plurality of second semiconductor switches are normally in their respective on states and are adapted to be caused to assume their respective off states and thereafter to be caused to reassume their respective on states after a third predetermined period of time;

said second predetermined period of time being longer than said first predetermined period of time and shorter than said third predetermined period of time;

whereby the voltage appearing on the respective drains of each of said plurality of second semiconductor switches is always adapted to be output via a corresponding one of said output terminals to a corresponding one of said sections of said control electrode during the operation of said drive circuit.

14. The driving circuit for driving a control electrode in an image forming apparatus according to claim 13, wherein at least one of said plurality of high-voltage power supplies, or at least one of said plurality of low-voltage power supplies, provide two or more levels of voltage.

* * * * *